United States Patent [19]

Allington

[11] Patent Number: 4,587,463

[45] Date of Patent: May 6, 1986

[54] ABSORBANCE MONITOR

[75] Inventor: Robert W. Allington, Lincoln, Nebr.

[73] Assignee: Isco, Inc., Lincoln, Nebr.

[21] Appl. No.: 534,581

[22] Filed: Sep. 22, 1983

[51] Int. Cl.[4] ..... H05B 41/36

[52] U.S. Cl. ..... 315/307; 315/279; 315/282; 315/287; 315/DIG. 7

[58] Field of Search ..... 315/307, DIG. 7, DIG. 5, 315/279, 282, 287, 219, 209 R

[56] References Cited

U.S. PATENT DOCUMENTS

| | | | |
|---|---|---|---|
| 3,896,336 | 7/1975 | Schreiner et al. | 315/DIG. 5 X |
| 4,053,813 | 10/1977 | Kornrumpf et al. | 315/DIG. 7 X |
| 4,060,752 | 11/1977 | Walker | 315/307 X |
| 4,128,788 | 12/1978 | Lowther | 315/219 X |
| 4,132,925 | 1/1979 | Schmutzer et al. | 315/307 X |
| 4,220,896 | 9/1980 | Paice | 315/DIG. 7 X |
| 4,240,009 | 12/1980 | Paul | 315/287 X |
| 4,339,692 | 7/1982 | Lasecki et al. | 315/219 X |
| 4,358,716 | 11/1982 | Cordes et al. | 315/DIG. 7 X |

*Primary Examiner*—David K. Moore

*Assistant Examiner*—Vincent DeLuca

*Attorney, Agent, or Firm*—Vincent L. Carney

[57] ABSTRACT

To provide a reliable start for cadmium and zinc lamps and reduce baseline noise in an absorbance monitor, voltage pulses are applied to the primary of a transformer followed by shutoff of the primary current which discharges the energy stored in the magnetizing inductance of the transformer as three thousand volt peaks in its secondary in a series of timed steps. At the end of the timed period, the system shuts down unless it has approached operating frequency. The frequency is controlled by the amount of current passing through a gas discharge lamp in circuit with the transformer secondary and the frequency controls the amplitude of the voltage spikes. After warm-up, blanking pulses prevent optical noise from electrical-path-change oscillations within the tube. In one embodiment, a constant current source controls the current and in another, an operating current and frequency are established by the transformer leakage inductance and lamp characteristics in the circuit.

22 Claims, 14 Drawing Figures

ABSORBANCE MONITOR

BACKGROUND OF THE INVENTION

This invention relates to absorbance monitors or detectors and more particularly relates to gas discharge lamp control circuits for absorbance monitors.

Gas discharge lamps are difficult to operate efficiently because their starting voltages are much higher than their running voltage. Typical values are 2000 volts starting and 180 volts running.

In one type of lamp control circuit intended to address this problem, high potential peaks are applied across the lamps to cause them to ignite and then a lower potential AC is applied to the lamp to keep it illuminated. After warm-up of the lamp, oscillations caused by different ionization paths within the lamp are reduced by narrow blanking pulses.

In a prior art type of absorbance monitor of this class, separate circuits or changes in material circuit parameters are used to apply the high voltage starting pulses and the lower voltage operating potential, and frequency is set and controlled at the set frequency or maintained at a constant rate.

This type of prior art absorbance monitor has several disadvantages such as, for example: (1) it frequently requires an expensive transformer; (2) there is excessive baseline noise; (3) the blanking pulses sometimes prevent ignition during start-up and warm-up; (4) it is energy inefficient, heavy or bulky; and (5) its lamp life is relatively short.

In another type of prior art circuit, a "flyback transformer" is used to operate high voltage pulses. Its disadvantages are poor form factor of the current through the lamp, an enhanced tendency to cause the gas discharge lamp to rectify, thus reducing the life due to deleterious electrode effects; and comparatively large size and weight of the transformer due to inefficient use of the magnetic energy storage capabilities of its core.

In yet another type of prior art circuit, a transformer is used whose core saturates at the end of each cycle or half cycle when the lamp is running as well as when starting. This type of prior art circuit has a disadvantage in that the saturation during running wastes power and is energy inefficient.

SUMMARY OF THE INVENTION

Accordingly, it is an object of the invention to provide an improved absorbance monitor.

It is a further object of the invention to provide a novel method for controlling the lamps in an absorbance monitor.

It is a still further object of the invention to provide a novel lamp control circuit for an absorbance monitor.

It is a still further object of the invention to provide an improved circuit and method for controlling the current through a lamp using the same circuitry during start-up and operating conditions.

In accordance with the above and further objects of the invention, there is provided a control circuit for gas lamps in an absorbance monitor having a lamp transformer and a drive circuit connected to the transformer. A control circuit applies relatively long-duration voltage pulses to the transformer primary winding during start-up, and forces the resultant primary current to zero at the transition between pulses. During this time the energy in the transformer field's magnetizing inductance is discharged through the secondary winding, resulting in high voltage spikes across the gas lamp.

As the gas in the lamp breaks down, the current through the lamp increases and this activates circuitry which increases the frequency of the voltage pulses on the primary of the transformer until the lamp is operating at its operating frequency and current. Typically, the required lamp starting voltage is ten times the lamp operating or running voltage.

The current through the lamp controls the frequency of the pulses and thus provides a measure of the operating conditions of the circuit. Blanking pulses are provided to reduce plasma oscillations in the lamp after warm-up and a timing circuit inhibits the blanking pulses until the lamp has warmed. If the lamp does not fire, a timing circuit turns off the control circuit after a period of time.

In one embodiment, the current to the primary of the transformer is provided by a constant current source and the lamp current is controlled in the transformer secondary by the transformer ratio. In another embodiment the lamp current is controlled by transformer ratio and the transformer leakage inductance and reaches an operating value established by the leakage inductance of the transformer and the operating frequency.

From the above description it can be understood that the control circuit of this invention has several advantages, such as: (1) it uses the same equipment to provide high starting voltage pulses as for proving operating conditions; (2) it reduces baseline noise in the absorbance monitor; and (3) it prevents blanking pulses intended to suppress noise from different ionization paths in the lamp from inhibiting start-up of the lamp.

SUMMARY OF THE DRAWINGS

The invention and the above noted and other features of the invention will be better understood from the following detailed description when considered with reference to the accompanying drawings in which.

DETAILED DESCRIPTION

Figure 1:
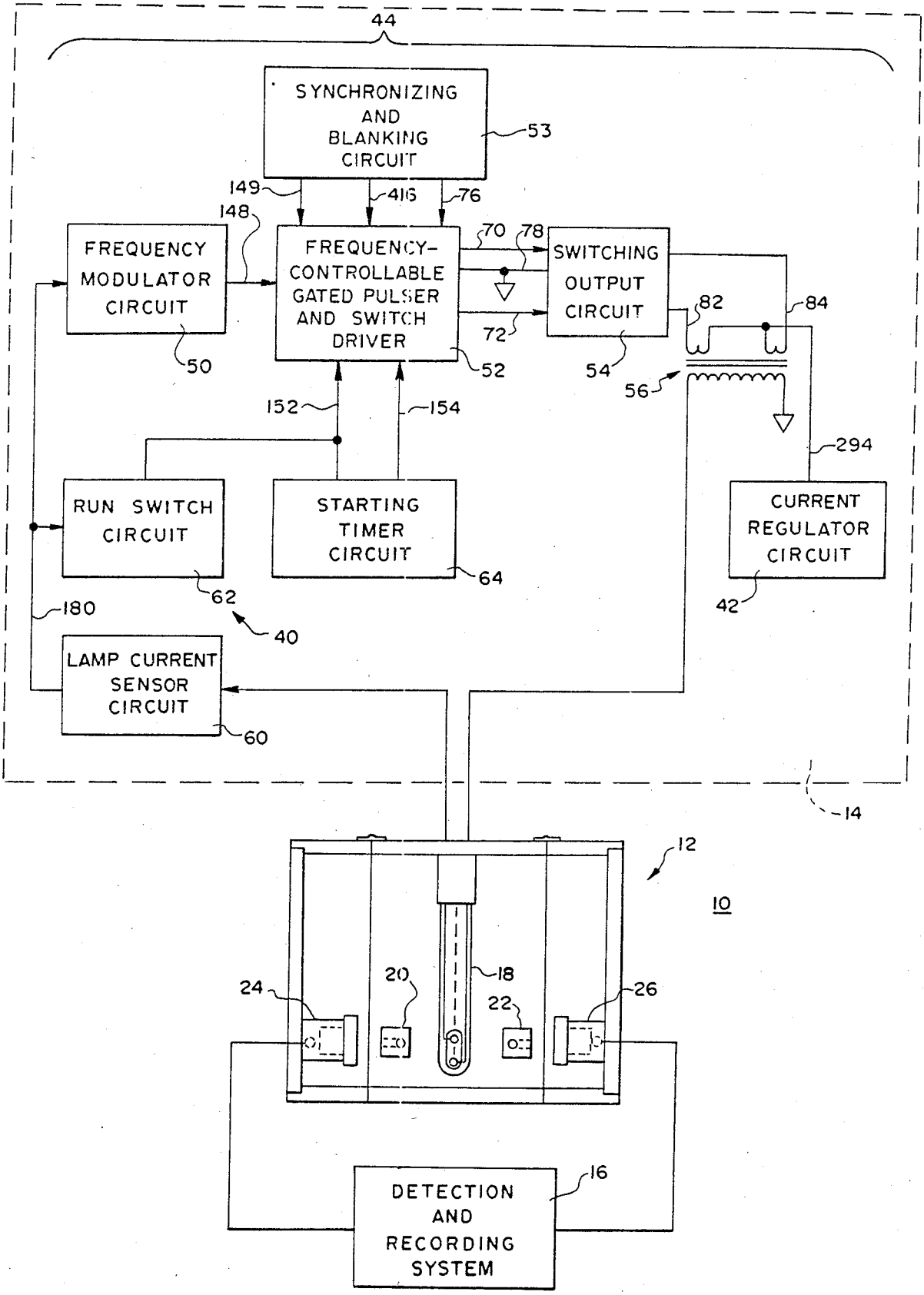
FIG. 1 is a block diagram of an embodiment of the invention.

In FIG. 1 there is shown a schematic view of an absorbance monitor 10 having as its principal parts related to this invention, a dual beam optical system 12, a light source control circuit shown generally at 14 and a detecting and recording system shown generally at 16. The detecting and recording system 16 of the absorbance monitor 10 is not part of the invention except insofar as it cooperates with the light source 12 and the light source control circuit 14 which is connected to the light source 12 for control purposes.

The dual beam light source 12 has as its principal parts a lamp 18, first and second flow cells 20 and 22 and first and second photocells 24 and 26 arranged so that the lamp 18 emits light which is focused through the flow cells 20 and 22 onto the photocells 24 and 26.

The flow cells 20 and 22 are conventional and normally a reference solution flows through one and a solution with substances to be identified through the other. The light passing from the lamp 18 through the flow cells 20 and 22 is converted to electrical signals in the photocells 24 and 26 which are applied to the detecting and recording system 16 to determine the light absorbance of the solution and thus provide information, usually in the form of chromatographic peaks, indicating the nature of the substances in the fluid. Such dual beam light source 12 is described more fully in U.S. Pat. No. 3,783,276. The lamp 18 may be a zinc lamp, a cadmium lamp or a mercury lamp. All of these lamps are gaseous discharge lamps intended to emit certain frequencies in certain spectrums for use in monitoring equipment.

The light source control circuit 14 is illustrated as electrically connected for zinc or cadmium gaseous discharge lamps and for that purpose includes a starting control circuit 40, a current regulator circuit 42 and a frequency and drive control circuit 44. The frequency and drive control circuit 44 provides the pulses for starting and operating the lamp 18. The starting control circuit 40 is connected to and cooperates with the frequency and drive control circuit 44 to control high voltage starting pulses applied during the start-up time; and the current regulator circuit 42 is connected to the frequency and drive control circuit 44 to control operating conditions.

The frequency and drive control circuit 44 includes a frequency modulator circuit 50, a frequency-controllable, gated pulser and switch circuit driver circuit 52 (hereinafter referred to as "gated pulser"), a synchronizing and blanking circuit 53, a switching output circuit 54 and a lamp transformer 56. The gated pulser circuit 52 generates pulses at a frequency which, during start-up, is controlled with fixed circuitry and, during normal running, is controlled by the frequency modulator circuit 50 to which it is connected.

In one embodiment, the synchronizing and blanking circuit 53 provides start-up timing and synchronizing signals to the gated pulser circuit 52 in a manner to be described hereinafter. The change-over in frequency is controlled by the starting control circuit 40 and the switching output circuit 54 receives pulses from the gated pulser circuit 52 and drives the lamp transformer 56 which in turn applies power to the lamp 18.

The starting control circuit 40 includes a lamp current sensing circuit 60, a run switch circuit 62 and a starting timer circuit 64. The starting timer circuit 64, the run switch circuit 62 and the frequency modulator circuit 50 are electrically connected to the gated pulser circuit 52 to control it during start-up for a fixed period of time.

During start-up, the frequency modulator circuit 50 causes the gated pulser circuit 52 to operate at a low frequency, for example, 90 Hz. These long-duration pulses cause current in the transformer primary, which is limited by its magnetizing inductance to build up to a high value, preferably at least partly saturating the core.

At the end of each pulse, a forced, current cutoff causes the magnetic energy stored in the core of the lamp transformer 56 to provide high voltage pulses to the lamp 18 while the starting timer circuit 64 waits for about four seconds, after which, if the lamp current sensing circuit 60 has not sensed a current corresponding to a transition to an operating condition and signaled the run switch circuit 62 through conductor 180, the starting timer circuit 64 shuts down the circuit to prevent damage to the transformer. This current, when sensed, may be the same or less than the normal running or operating current.

If the lamp is ignited by the high peak pulses during the first four seconds, the lamp current sensor circuit 60 causes the frequency modulator circuit 50 to raise the frequency of the pulses to be generated by the gated pulser circuit 52 for operation of the lamp.

At this higher frequency, the core of the transformer does not: (1) saturate and waste energy; or (2) adversely affect or shunt its operation as a generator of secondary voltage proportional to the turns ratio and primary voltage or as a generator of secondary current inversely proportional to the turns ratio and the primary current. Of course this voltage to current relationship is subject to the effects of lamp voltage drop, transformer resistance and leakage inductance. The leakage inductance is much less than the magnetizing inductance. It may be said that little current flows through the magnetizing impedance during normal running operation at sufficiently high frequency.

The energy stored in the core of the lamp transformer 56 from the source of current before ignition of the lamp 18 must be sufficient to generate a voltage peak in the secondary of the transformer of at least 1,000 volts for a commonly available zinc or cadmium lamp and preferably 3,000 volts during start up and the current must be adequate to maintain ignition of the lamp. The output circuits of the gated pulser circuit 52, switching output circuit 54, lamp transformer 56 and current regulator circuit 42 are selected so that they have values, which when operated upon in circuit with each other result in a voltage pulse equal at least to 1,000 volts.

These high voltage pulses arise from the rate of change of current from the initial amount provided by the current regulator circuit 42 through the primary of the lamp transformer 56 with respect to time controlled by the fall times of the switching transistors in the switching output circuit 54, limited by parasitic capacities and transformer core loss in amperes per second multiplied by two other values which are: (1) the magnetizing inductance of the transformer in henries; and (2) the ratio of turns of the secondary of the transformer in series with the lamp to the turns of the primary of the transformer through which the current is flowing.

Figure 2:
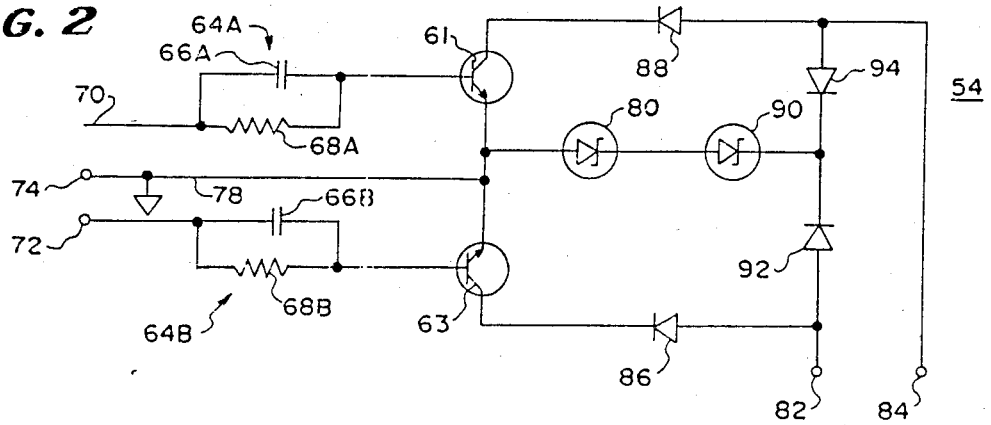
FIG. 2 is a schematic circuit diagram of a portion of the embodiment of FIG. 1.

In FIG. 2 there is shown a schematic circuit diagram of the switching output circuit 54 having first and second output transistors 61 and 63 and first and second RC reverse base or shutoff driver circuits 64A and 64B. Each of the RC circuits 64A and 64B includes a corresponding one of the capacitors 66A and 66B and a corresponding one of the resistors 68A and 68B with each capacitor being connected in parallel with its corresponding resistor, having one of its plates electrically connected to the base of a respective one of the NPN transistors 61 and 63 and its other plate electrically connected to a respective one of the input terminals 70 and 72.

To receive drive pulses for the generation of output pulses for transmission to the transformer 66 (FIG. 1), the input terminals 70 and 72 and the circuit common or circuit ground or "A.C. ground" terminal 74 are electrically connected to the gated pulser circuit 52 (FIG. 1). The terminal 74 is electrically connected through a conductor 78 to AC ground, the emitters of transistors 61 and 63 and the anode of a zener diode 80.

To provide output pulses to the lamp transformer 56 (FIG. 1), first and second output terminals 82 and 84 are each electrically connected to the collectors of a different one of the transistors 61 and 63 through the forward resistance of a respective one of the reverse blocking diodes 86 and 88 and to the cathode of a zener diode 90 through a respective one of the diodes 92 and 94 with the cathode of the zener diode 80 being electrically connected to the anode of the zener diode 90 to form an overvoltage clamp circuit.

The reverse blocking diodes are not usually found in what at first may appear to be similar circuits, commonly called "inverter circuits." These diodes insure the voltage spikes. Voltage spikes are undesirable in common inverter circuits. The overvoltage clamp circuit limits the voltage spikes to 200 volts in the primary of the lamp transformer 56 (FIG. 1) if the lamp 18 does not ignite, preventing rapid damage to the transformer due to secondary voltage in excess of 3,200 volts because of the 16 to 1 transformer ratio.

In the start-up mode, the transistors 61 and 63 receive pulses from the gated pulser circuit 52 with one of the transistor bases receiving a positive pulse while the other receives a negative pulse due to charge stored in its respective base capacitor 66A or 66B. The negative base drive provided by capacitor 66A and 66B causes transistors 61 and 63 to switch rapidly when they turn off. This is important for providing high voltage pulses because the amplitude of the voltage pulses are dependent on the rate of change of the current. This is followed by a reversal of drive from gated pulser circuit 52 so that the transistors are alternately driven off and driven into conducting, since their emitters are grounded.

The negative-driving pulses on one of the inputs 70 and 72 from the gated pulser circuit 52 to the switching output circuit 54 overlap because the negative going pulses applied to terminals 70 and 72 by the gated pulser circuit 52 have a longer time duration than the positive going pulses by five microseconds, causing a five microsecond period of time during which the bases of both transistors 61 and 63 are negative. This is done to insure that both transistors do not conduct simultaneously during the transitions, in spite of the fact that their turn-off times are usually longer than their turn-on times.

During the start-up phase of a cycle, when one of the transistors 61 and 63 is conducting, current flows from one of terminals 82 or 84 which are connected to the transformer 56 (FIG. 1) to ground through the conducting transistor. During this time, energy is stored as a magnetic field in flux in the core of the transformer so that when the dead time period occurs which terminates the current flow through this transistor, a high-voltage positive peak is generated.

The collector of the transistor is clamped by zener diodes 80 and 90 to a maximum of two hundred volts to the grounded center conductor 74. This relatively narrow two hundred volt pulse is transformed by the 16 to 1 lamp transformer 56 (FIG. 1) into about 3000 volts in the secondary where it is applied to the lamp 18 and causes ionization.

The corresponding 200 volt negative pulse generated by transformer action at the opposite end of the transformer primary is not applied to the other transistor because it reverse biases the corresponding reverse blocking diode 86 or 88. Such diodes are not usually used in switching power supplies and are an important element in forming the high voltage starting pulses in the embodiments shown in the figures. Without them, the pulses would be undesirably clamped in a relatively low voltage due to reverse conduction within the transistors.

During the start-up period, the transformer 56 becomes saturated and a transformer is selected with sufficient characteristics for that saturation. Normally, it will have a lower magnetizing inductance and lower saturation flux density than conventionally would be intentionally selected for the starting frequency used, and thus will often be a less expensive transformer. It has been found that a starting frequency of 100 Hz is practical at a supply voltage of 24 volts DC for a particular transformer with a magnetizing inductance of about 0.8 henry and core saturation at a primary current of 0.5 ampere with no current in the secondary. Increasing the current past the saturation of the core before the end of the half-cycle has been found to produce more energetic high voltage starting pulses. At the end of each ½ cycle, the core is very saturated at about 0.7 ampere.

For this particular transformer an operating frequency of 1000 Hz is practical in an embodiment where the current is regulated by current regulator circuit 42 and an operating frequency of about 5000 Hz in practice in an embodiment wherein the current is regulated by the leakage inductance of the transformer.

In the embodiment in which the running current to the lamp is regulated by the operating frequency, a practical and useful operating frequency is determined by the transformer's leakage inductance which is about 20 millihenries. This inductance is an economical value, as it is typical of what may be expected in a low cost laminated silicon-iron core high voltage transformer with separate bobbins for the primary and secondary windings. The frequency can easily be adjusted to suit the leakage inductance of this type of transformer with the transformer designed for minimum cost rather than to some extreme value of leakage inductance which differs from the most straightforward and economical amount.

During normal operation, the gated pulser circuit 52 provides pulses at a higher frequency under the control of the lamp current sensor circuit and frequency modulator circuit once the lamp begins conducting. Under these conditions, the lamp transformer 56 (FIG. 1) is not saturated because at the higher running frequency the magnetizing current of the transformer does not have time enough to build up to saturation. The operating or running voltage of the lamp is only about 200 volts so most of the current in the primary circuit of the transformer is transformed in the secondary circuit.

In this mode of operation, the current regulator circuit 42 provides a substantially constant 40 milliamperes average for zinc or cadmium lamps in one embodiment or 18 milliamperes average in another embodiment for mercury lamps with the current flowing from the current regulator circuit 42 through either of the primary loops so that it alternately flows through terminal 82 and then through terminal 84 and thus respectively through transistor 63 to ground and then through transistor 61 to ground to provide an alternating output transformed through the lamp transformer 56 to the lamp 18 (FIG. 1). The lamp power is usually more closely proportional to the average current, not its RMS (root mean square) current because the lamp voltage, after striking, varies little with current throughout its normal current operating range.

The impedance of the load connected to secondary is more than 200K ohms with an unfired tube and the energy of the collapsing field should be sufficient to create at least 2K volts across it for about 1 milliseconds. For some lamps 1000 volts for 10 milliseconds at a higher impedance is adequate. This field is typically created by a primary current buildup during a period of less than 5 milliseconds. For this situation, the inductance and primary current must be sufficiently high and the losses sufficiently low to result in a sufficiently high energy field.

Figure 3:
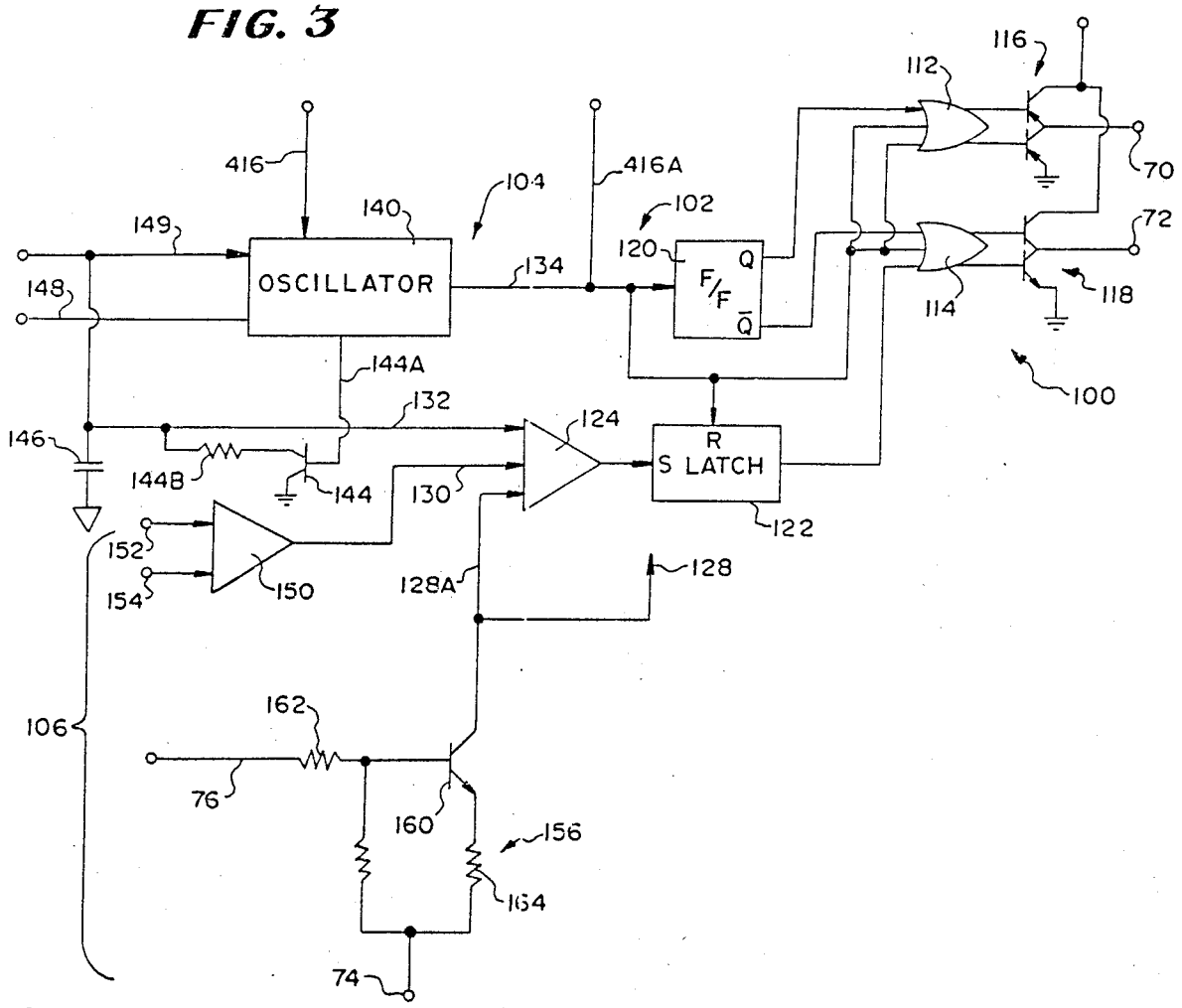
FIG. 3 is a schematic circuit diagram of another portion of the embodiment of FIG. 1.

In FIG. 3, there is shown a schematic circuit diagram of the gated pulser circuit 52 having an output stage 100, a control stage 102, a timing stage 104 and a shut-down stage 106.

The gated pulser circuit 52 is a circuit of a type which is available under the designation SG3525A from Motorola Semiconductor Division in Phoenix, Ariz. While that commercial unit is purchased and used to provide the components shown in FIG. 3, there are additional components on the actual commercial "pulse-width modulator" used as a gated pulser which are omitted from FIG. 3 for the purpose of clarity. The pulse-width modulator is described in printed publications of Motorola Corporation under the designation "Pulse Width Modulator Control 10 Circuit SG1525A/SG1527A".

To provide base current to one and remove base current from the other of the transistors 61 and 63 of the switching driver circuit 54 (FIGS. 1 and 2), and thus drive the lamp transformer 56, the output drive circuit 100 includes gates 112 and 114 connected to transistor output circuits 116 and 118 described more fully in the aforesaid Motorola manual and constituting a totem pole design. This circuit, when connected to the push-pull arangement of FIG. 2, provides fast cut-off and a dead time which is adjustable between the two stages of output to account for the turn-off times of transistors 61 and 63.

With this arrangement, the transistor cascade output circuit 116 may either provide turn-on drive current to the input terminal 70 or pull (provide turn-off drive) current from it and the cascaded transistors 118 either pull current or provide it to the input terminal 72. The time of pulling current is slightly longer than the drive time to cause both transistors 61 and 63 (FIG. 2) never to conduct simultaneously.

To control the output drive circuit 100, the control circuit 102 includes a flip-flop 120, a latch 122 and a comparator 124. Comparator 124 has a first input 132 connected to capacitor 146, a second input 130 connected to the output of amplifier 150 and a third input 128A connected to the collector of transistor 160. If either the second input 130 or third input 128A of comparator 124 carries a lower potential than the first input 132, the comparator produces a "set" signal at its output which is connected to the set input terminal of the latch 122. Current source 128 connected to the collector of transistor 160 brings the third input 128A of comparator 124 "high" when the transistor 160 is turned off.

The latch 122 is reset by a pulse from the oscillator 140 of synchronizing circuit 104 on a conductor 134 which also changes the state of or "toggles" the flip-flop 120 and applies a pulse to the OR gates 112 and 114 in the output drive circuit 100. In another embodiment (FIG. 14) this pulse is applied through conductor 416A in a manner to be described hereinafter. The set output of the flip-flop 120 is electrically connected to the OR gate 112 and the reset output terminal is connected to the OR gate 114, to open one gate and close the other depending upon the state of the flip-flop 120, thereby alternately turning on and off the outputs 70 and 72. The latch output is connected to both OR gates 112 and 114 so that a pulse is provided through the OR gates 112 or 114 in response to either state of the flip-flop 120, with the latch 122 providing dead time in synchronism with the synchronizing circuit 104.

To synchronize operation and provide repeatable lamp re-ignition conditions, the synchronizing circuit 104 includes an oscillator 140, a transistor 144, an external timing frequency capacitor 146, a dead-time setting resistor 144B and conductors 148, 149 and 416. The conductor 134 provides blanking pulses which switch flip-flop 120 and turn off transistors 61 and 63 (FIG. 2).

In all embodiments, conductor 144A controls the base of NPN transistor 144 which has its emitter grounded and in some embodiments has its collector connected to frequency control capacitor 146 through resistor 144B. Conductor 144A goes positive when oscillator 140 produces an output pulse on line 134. At this time the capacitor discharges through resistor 144B and transistor 144.

Capacitor 146 is charged by current from oscillator 140 through line 149. The current in conductor 149 is in turn controlled by setting the current flow out of conductor 148. Thus, a reduced current flow through conductor 148 changes the frequency to provide a frequency at start-up that is lower than the operating frequency and provides a high voltage startup of the lamp. Inceasing the current in conductor 148 increases the frequency of oscillator 140 and decreasing the current in conductor 148 decreases the frequency of oscillator 140; and the operating frequency is set by the frequency of oscillator 140 (FIGS. 1 and 3).

To turn off the circuitry and to control the start-up and turn off times, the shut-down stage 156 includes a differential amplifier 150, having first and second input terminals 152 and 154, and a shut-down circuit 156. The shut-down circuit 156 incudes an NPN transistor 160, having its base connected to the terminal 76 through a resistor 162, a collector connected to a constant current source 128 and to an input of the comparator 124 and an emitter connected to circuit common or circuit ground through a resistor 164. The terminal 74 is connected to circuit ground.

In one embodiment, the conductor 76 is grounded and in another embodiment it is connected to conductor 416 for gating and sychronization purposes. When conductor 416 receives a positive gating pulse, oscillator 140 causes transistor 144 to turn on discharging capacitor 146 and oscillator 140 also gates off output circuits 116 and 118 through lead 134 and gates 112 and 114. A positive gate pulse on conductor 76 turns on transistor 160, setting latch 122 through lead 128A to comparator 124. This insures that gates 112 and 114 keep output circuits 116 and 118 turned off during the entire gate pulse.

The conductors 152 and 154 control the amplifier 150 and thus the comparator 124 through lead 130. The comparator 124 is also controlled by leads 128A and 132. The frequency is controlled at about 100 to 130 hertz at start-up to a running or operating frequency of between 750 and 1,100 hertz in one example.

The amplifier 150 compares the output potential from the run switch circuit 62 received on conductor 152 and a reference potential from the starter timer circuit 64 received on conductor 154 (FIG. 1). In one embodiment, the frequency is controlled by controlling the current leaving oscillator 140 on conductor 148, which in turn varies the charging current on lead 149 and the rate of charge of capacitor 146.

When the voltage on lead 149 reaches a preset amount, it triggers oscillator 140 to put positive voltage on leads 134 and 144A. This turns on transistor 144, discharging capacitor 146 through resistor 144B. When the voltage on lead 149 drops to a second preset amount, oscillator 140 removes the voltage from leads 134 and 144A, and the cycle repeats as capacitor 146 charges again.

If lack of current through the lamp 12 (FIG. 1) indicates that it has not begun conducting in four seconds as timed by the starter timer circuit, conductor 152 drops in potential to a potential near ground while conductor 154 remains positive and the comparator 124 receives a negative potential on conductor 130 which sets the latch 122 to shut off the drive circuits.

Current applied to conductor 148 by the frequency modulator circuit 50 (FIG. 1) is connected within the oscillator 140 to vary the charging current of capacitor 146 to change the frequency of the oscillator 140. Signals from the frequency modulator circuit 50 under the control of the lamp current sensor circuit 60 (FIG. 1) cause the frequency from the oscillator 140 to be increased smoothly and gently from 130 hertz at start-up to the range of 750 to 1,100 hertz during the run conditions and thus control the switching of the flip-flop 120 through the oscillator 140 and the frequency of pulses provided to the switching output circuit 54 (FIG. 1).

Figure 4:
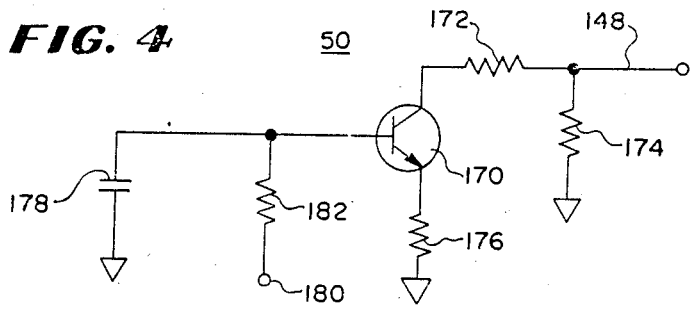
FIG. 4 is a schematic circuit diagram of still another portion of the embodiment of FIG. 1.

In FIG. 4 there is shown a schematic circuit diagram of the frequency modulator circuit 50 having an NPN transistor 170 and capacitor 178. The conductor 148 electrically connects the oscillator 140 (FIG. 3) through resistor 172 to the collector of the transistor 170 whose emitter is connected to ground through resistor 176. Resistor 174 provides minimum current on lead 148 to produce a low frequency from oscillator 140 (FIG. 3) during start up conditions when transistor 170 is not on at all.

The base of the transistor 170 is electrically connected to ground through capacitor 178 and to a terminal 180 through a resistor 182, with the terminal 180 being electrically connected to the lamp current sensing circuit 60 (FIG. 1) for the purpose of controlling the frequency of the gated pulser circuit 52 (FIG. 1) during the transition from start-up to run and during run. The conductor 148 is connected to the frequency-adjustment resistance input of the oscillator 140 (FIG. 3) to control the frequency of the oscillator 140.

The potential applied to terminal 180 represents the current flow and controls the impedance of transistor 170. As the current increases, the impedance of transistor 170 decreases to connect resistors 174 and 172 is parallel with resistor 174 to ground. This circuit establishes the charging rate of capacitor 146 and raises the frequency of the oscillator 140 (FIG. 3) as the current increases to its running current. The resistance of resistor 174 is larger and can be much larger than that of the resistors 172 and 176 so that as a practical matter, the oscillator frequency may be changed over a wide range.

The RC time constant of capacitor 178 and resistor 182 is large enough so that the oscillator frequency does not rise so rapidly that the lamp does not fail to stay ignited during the transition from start up to run. In one embodiment, an RC time constant of ½ second has been found to be satisfactory.

Figure 5:
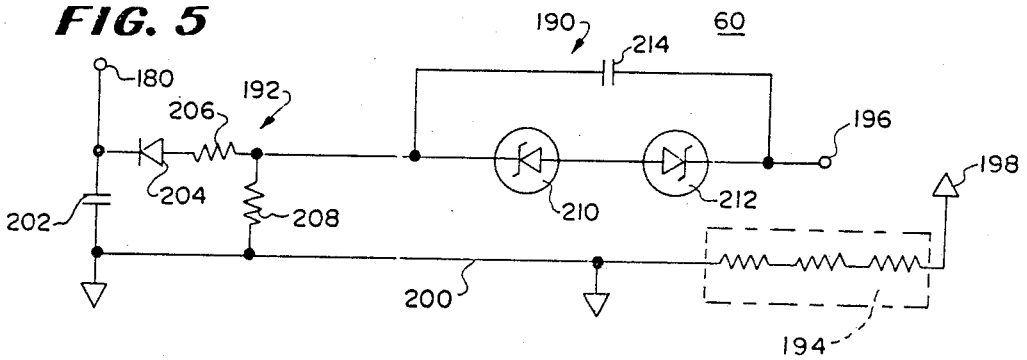
FIG. 5 is a s;chematic circuit diagram of still another portion of the embodiment of FIG. 1.

In FIG. 5 there is shown a schematic circuit diagram of the lamp current sensing circuit 60 having a lamp rectification prevention section 190, a current sensing section 192 and a heater section 194. The terminal 196 is electrically connected to the lamp 18 to receive the current passing therethrough and is connected to the rectification prevention section 190. A source of positive potential 198 is electrically connected to one end of the heater section 194, the other end of which is connected to circuit ground and to the current sensing section 192 through a conductor. The source of potential 198 is only on when the apparatus is turned off. Its connection to heater section 194 when the absorbance monitor is turned off tends to decrease warm up time by preheating the apparatus to near operating temperature before it is turned on. Since it is automatically turned off when the absorbance monitor is turned on, it does not affect the operating temperature of the absorbance monitor.

The current sensing section 192 includes a filter capacitor 202, a diode 204 and first and second resistors 206 and 208. The resistor 208 is electrically connected to the conductor 200, which is connected to ground and to one plate of the capacitor 202 and the other end of the resistor 208 is electrically connected to the antirectification section 190 and to one end of resistor 206. The other end of resistor 206 is electrically connected through the forward resistance of diode 204 to the other plate of the capacitor 202 and to the terminal 180.

The lamp rectification prevention section 190 includes first and second zener diodes 210 and 212 and a capacitor 214. The zener diodes 210 and 212 have their anodes connected to each other and their cathodes electrically connected to different plates of the capacitor 214, with the cathode of the zener diode 212 being electrically connected to terminal 196 and the cathode of the zener diode 210 being electrically connected to one end of the resistor 206 and one end of the resistor 208.

The heater section 194 includes a plurality of resistors, one of which may be varied to accommodate different types of lamps and which together provide different heating resistances for establishing the proper standby temperature when the absorbance monitor is turned off.

In operation, current flowing through the lamp 18 flows through terminal 196 and principally through the resistor 208 to conductor 200. This current is generally an AC current and if the lamp has any undesirable tendency to rectify, which can decrease its operating life, capacitor 214 receives a charge which opposes and stops such rectification. Zener diodes 210 and 212 protect capacitor 214 from any unusually gross fault condition.

The diode 204 rectifies the voltage drop across resistor 208 due to this current which is in the form of pulses of alternating polarity. This current charges the capacitor 202 after several pulses so that when substantial current is flowing through the lamp 18 (FIG. 1), the capacitor reaches a potential that provides a signal on conductor 180 indicating that the tube has fired.

The resistor 206 establishes a rate of charging which results in a potential across the capacitor 202 supplied to terminal 180 as a signal to the run switch circuit 62 (FIG. 1) and to the frequency modulator circuit 40 (FIG. 1). This signal indicates if the lamp 18 is nonconducting in its starting phase or just after its initial firing or if it is at its rated current.

Figure 6:
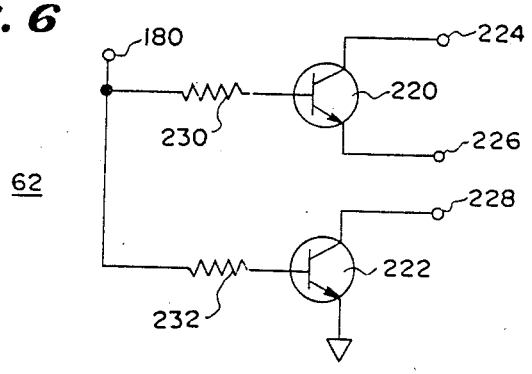
FIG. 6 is a schematic circuit diagram of still another portion of the embodiment of FIG. 1.

In FIG. 6 there is shown a schematic circuit diagram of the run switch circuit 62 having first and second NPN transistors 220 and 222 and first, second and third output terminals 224, 226 and 228. The base of the transistor 220 is electrically connected to terminal 180 through a resistor 230 and the base of the transistor 222 is electrically connected to the terminal 180 through a transistor 232. The collector of the transistor 220 is electrically connected to output terminal 224 and its emitter is electrically connected to terminal 226. The output terminal 228 is electrically connected to the collector of the NPN transistor 222 and its emitter is grounded.

The run switch circuit 62 receives a signal indicating the current through the lamp 18 is at least the starting amount (FIG. 1) on terminal 180 and provides signals to: (1) output terminals 224 and 226 indicating the starting condition of the lamp 18 to the starting timer circuit 64 (FIG. 1); (2) a second output at terminals 228 to the starting timer circuit 64; and (3) thence to the gated pulser circuit 52. The transistors are identical and both base resistors have a resistance of 22K (kiloohms). At the same potential, the transistors 220 and 222 provide corresponding signals to the starting timer circuit 64 which interprets these signals.

Figure 7:
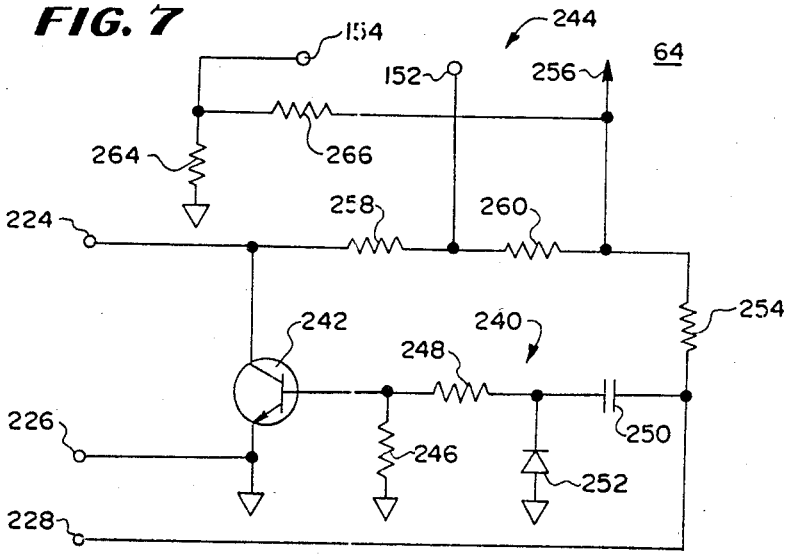
FIG. 7 is a schematic circuit diagram of still another portion of the embodiment of FIG. 1.

In FIG. 7 there is shown a starting timer circuit 64 including an RC time constant circuit 240, one NPN transistor 242 and an output circuit 244. The transistor 242 has its emitter grounded and electrically connected to terminal 226 and its collector electrically connected to terminal 224. The base of transistor 242 is electrically connected to resistor 248 and capacitor 250 which are the principal timing elements of RC time constant circuit 240.

To detect and provide a signal to the gated pulser circuit 52 indicating a failure to start after more than four seconds delay, the RC time constant circuit 240 includes a first resistor 246, a second resistor 248, a capacitor 250, a diode 252 and a resistor 254. The resistor 248 is electrically connected at one end to the base of the NPN transistor 242 and to ground through the resistor 246 and is electrically connected at its other end to the reverse resistance of the diode 252 and to one plate of the timing capacitor 250. The other plate of the timing capacitor 250 is electrically connected to terminal 228 and to a positive reference potential 256, provided by the Motorola SG3525A used as gated pulser circuit 52, through the resistor 254. A reference potential 256 is electrically connected to output terminal 224 through resistors 258 and 260.

The output section 244 includes terminal 154 electrically connected to one input of the amplifier 150 (FIG. 3) and terminal 152 electrically connected to the other input of the amplifier 150 (FIG. 3). Terminal 152 is electrically connected to a reference voltage 256 through the resistor 260 and to terminal 224 through the resistor 258. Terminal 154 is at a reference voltage produced by electrically connecting it to ground through a resistor 264 and to the source of a positive reference potential 256 through a resistor 266.

Because transistor 242 is initially conducting at startup because of current to its base through RC time constant circuit 240, it holds terminal 152 lower than terminal 154. The RC circuit 240 has a four second time constant and after this time transistor 242 shuts off, causing terminal 152 to rise above the level of terminal 154 and shut off the circuit unless transistor 220 (FIG. 6) connected to terminal 224 has become conducting. Transistor 220 conducts when it receives a sufficiently large signal on terminal 180, indicating ignition of the lamp 18 (FIGS. 1 and 5).

When the lamp 18 (FIG. 1) lights, capacitor 250 is immediately discharged through diode 252 and transistor 222 (FIG. 6) through terminal 228. This allows the starting cycle to repeat after an inadvertant main power interruption.

Figure 8:
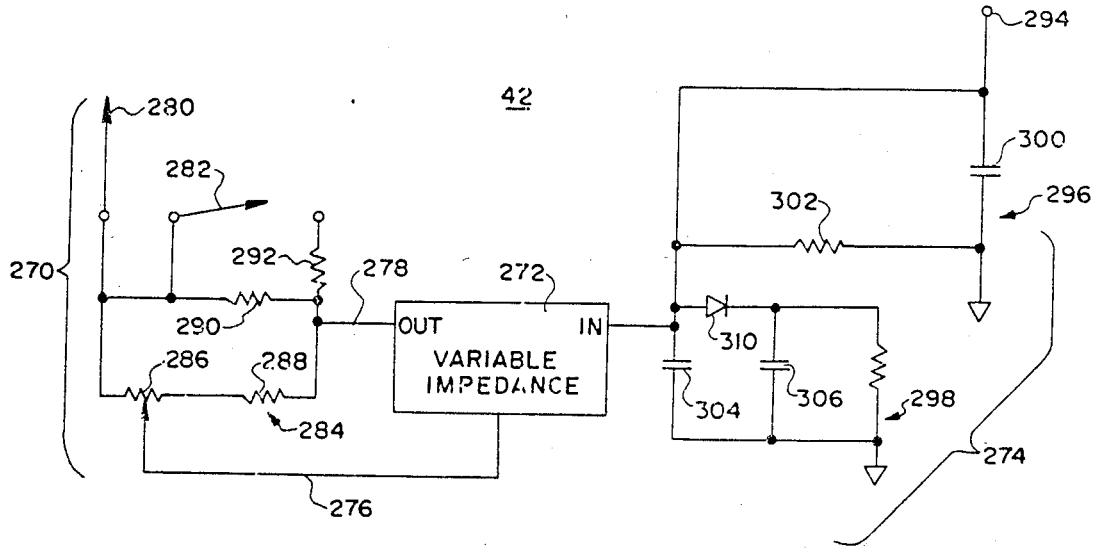
FIG. 8 is a schematic circuit diagram of still another portion of the embodiment of FIG. 1.

In FIG. 8, there is shown a schematic circuit diagram of the current regulator 42 having a biasing and control circuit 270, a variable impedance circuit 272 and a constant current output circuit 274. The biasing and control circuit 270 establishes a potential proportional to current flow which controls the variable impedance circuit 272 to maintain the current flow through the biasing and control circuit 270 from the primary of the lamp transformer 56 (FIG. 1) at a set value determined by the characteristics of the variable impedance circuit 272 and the component values in circuit 270.

The variable impedance circuit 272 may be any circuit for producing a constant current flow regardless of load voltage within a given range. In an embodiment using the frequency modulator circuit 50 of FIG. 4, an output current is maintained such that the potential across series sensing resistance is kept equal to that of a fixed reference potential internal to it by varying its internal impedance. Such a circuit is sold by National Semiconductors, Inc., under the designation, LM337. This integrated circuit is designed by National Semiconductors as a voltage regulator, but the manufacturer's literature suggests its use as a current regulator with its input and outut terminals reversed as shown in FIG. 8. The "IN" terminal of this integrated circuit (272) is connected to the constant current output circuit 274.

To provide the same set point voltage for different lamps requiring different currents, the biasing circuit 270 includes first and second output conductors 276 and 278, a source of potential 280, a switch 282 and a resistance bridge 284. The switch 282 alters the impedance of the resistance bridge 284 by shorting out certain resistors and is intended to adjust the current for different types of lamps 18 such as between a zinc halide lamp and a mercury lamp.

To provide a bridge divider for potential, the bridge circuit 284 includes a potentiometer 286, a first resistor 288, a second resistor 290 and a third resistor 292. The first output conductor 278 is connected at one end to the variable impedance circuit 272 and at its other end to: (1) one end of the resistor 292; (2) one end of the resistor 290; and (3) one end of the resistor 288. The other end of the resistor 292 is connected to the fixed contact of the switch 282 and the other end of the resistor 290 is electrically connected to the armature of the switch 282 to permit a parallel path across those two resistances that alters the resistance of the biasing circuit 270. This change in resistance enables different lamps to be accommodated by the absorbance monitor 10.

The source of reference potential 280 is electrically connected to the armature of the switch 282 and to one end of the potentiometer 286, the other end of the potentiometer 286 being electrically connected to the other end of the resistor 288. The center tap of the potentiometer 286 is electrically connected to output conductor 276 so that the biasing voltage is set between the conductors 276 and 278 for the variable impedance circuit 272.

The output circuit 274 includes a terminal 294 electrically connected to the lamp transformer 56 (FIG. 1), a first impedance network 296 and a second impedance network 298. The terminal 294 is electrically connected to the center tap of the lamp transformer 56 (FIG. 1) to control the current from the switching output circuit 54 through one or the other half of the primary winding of the lamp transformer 56 and thus maintain that current constant. The impedance networks 296 and 298 create an impedance between the variable impedance circuit 272 and the terminal 294 for purposes of protecting the circuits while maintaining the current at the desired set value.

The first impedance network 296 includes a capacitor 300 and a resistor 302 with the input terminal 294 being electrically connected to one plate of the capacitor 300, one end of the resistor 302 and to the input terminal of the variable impedance circuit 272. The other end of the resistor 302 and the other plate of the capacitor 300 are electrically connected to AC ground to shunt transient AC current to ground.

The second impedance network 298 includes first and second capacitors 304 and 306, a resistor 308 and a diode 310. Terminal 294 is electrically connected through the impedance network 296 to the input of the variable impedance circuit 272, the anode of the diode 310 and one plate of the capacitor 304. The cathode of the diode 310 is electrically connected to one plate of the capacitor 306 and one end of the resistor 308. The other plates of the capacitors 304 and 306 and the other end of the resistor 308 are electrically connected to AC ground to shunt voltage spikes to ground.

Capacitor 306 can be made much larger than capacitor 304 to enable it to absorb high energy voltage spikes without presenting a low impedance to terminal 294 which would degrade the constant curent performance of the circuit because such degradation would require the impossible reverse conduction of diode 310. Resistor 308 dissipates the energy of each spike stored on capacitor 306, so that capacitor 306 is ready to absorb the next spike.

The current regulator circuit 42 controls the current flow as each half of the switching output circuit 54 (FIGS. 1 and 2) provides current flow through the terminals 82 and 84 (FIGS. 1 and 2) to terminal 294 of the current regulator circuit 42 (FIGS. 1 and 8). Thus, the value of current amplitude set in the current regulator circuit 42 controls the current flow through either half of the primary of the lamp transformer 56 (FIG. 1). It controls the current flow from output terminal 82 or 84 of the switching output circuit 54 (FIGS. 1 and 2).

With this type of control, the potential of the secondary of the lamp transformer 56 is controlled by the lamp 18 (FIG. 1) and thus the potential used for start-up ignition of the lamp 18 or for its running operation may be affected to some extent by the current regulator circuit 42 insofar as the lamp does not have non-varying starting or does not have an absolutely flat, running voltage-to-current characteristic.

Figure 9:
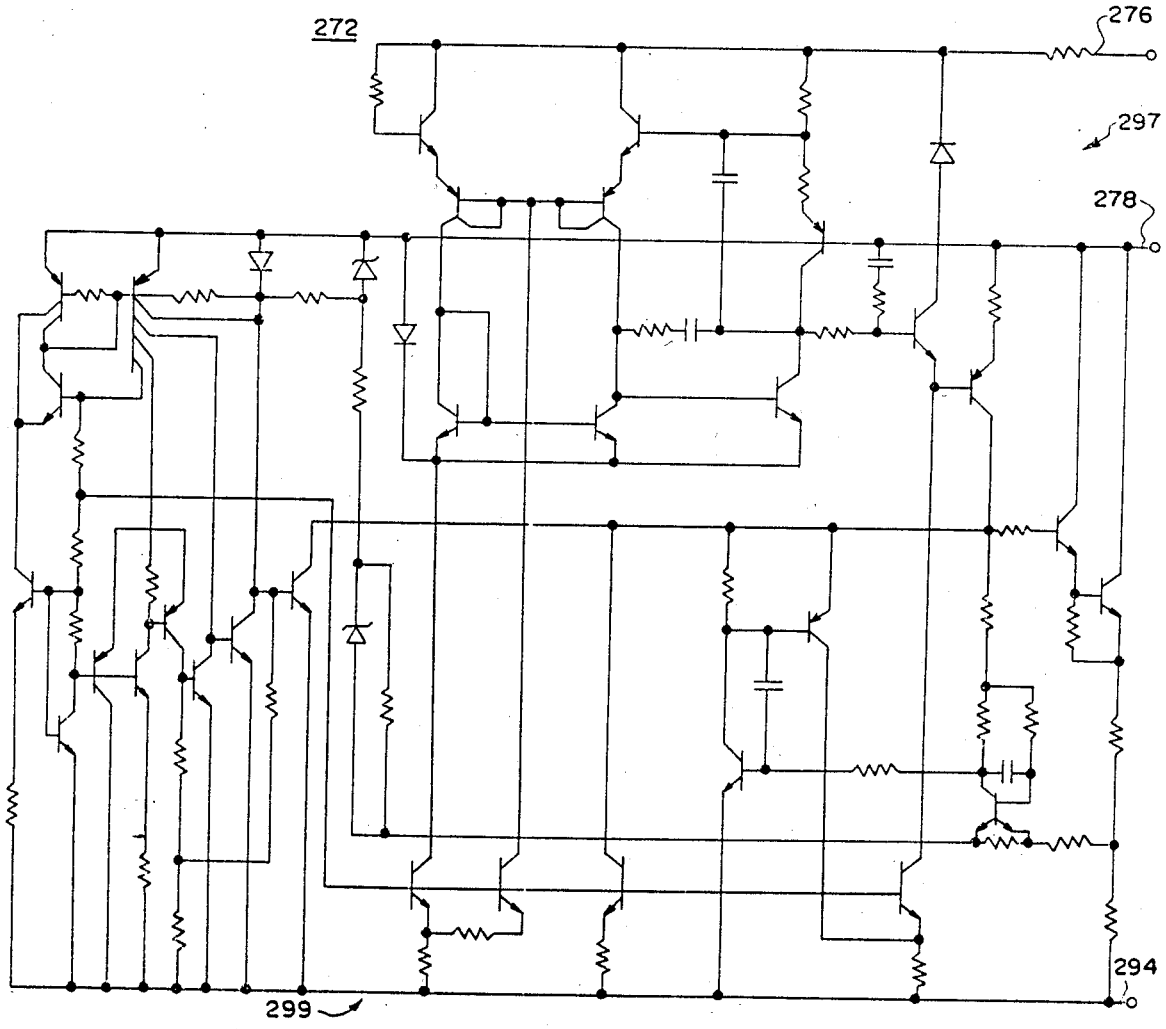
FIG. 9 is a schematic circuit diagram of a portion of the embodiment of FIG. 8.

In FIG. 9 there is shown a schematic circuit diagram of the variable impedance 272 which is the configuration of the National Semiconductor LM137/LM237/LM337 negative voltage regulator. This regulator can be used as a positive current regulator in the present embodiment with its nominal input and output terminals reversed.

A positive voltage regulator such as a National Semiconductor LM317 connected as a positive current regulator without reversal of its input and output terminals does not work as well because it is severely disturbed by the electrical fluctions on lead 294. The National Semiconductor LM137/LM237/LM337 maintains a constant negative 1.25 volts at terminal 278 with respect to terminal 276.

The current flowing through the transformer terminals 82 and 84 (FIG. 1) of the lamp transformer 56 from the current regulator circuit 42 has its value determined by the resulting potential difference applied between terminals 276 and 278 which controls the impedance between terminals 278 and 294. Since this impedance increases rapidly in response to an increase in potential drop between terminals 276 and 278, which is proportional to the current, this current is maintained constant regardless of changes in the lamp voltage. It is set by the voltage between conductors 276 and 278 through the biasing and adjustment circuit 270.

Figure 10:
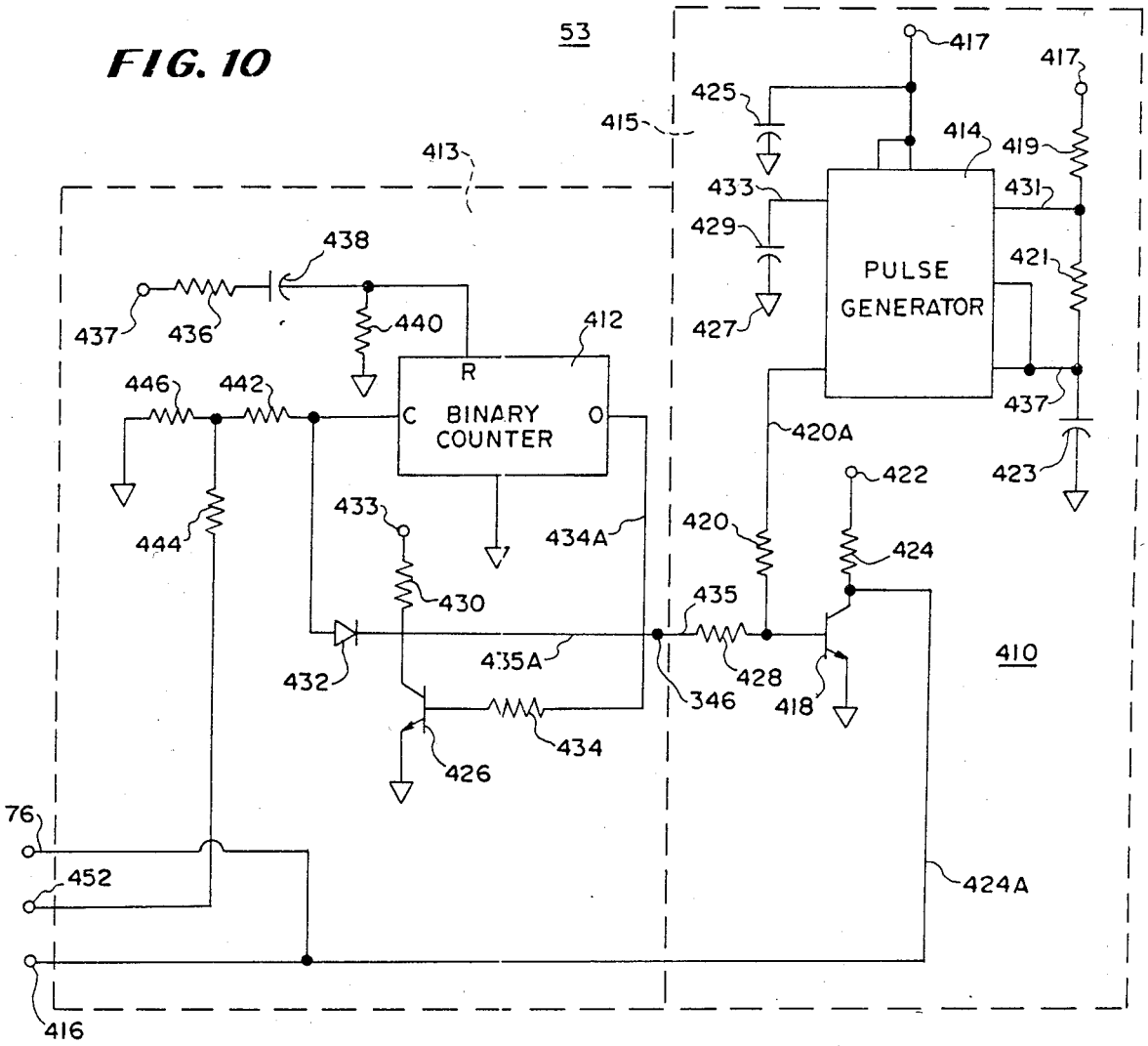
FIG. 10 is a schematic circuit diagram of a portion of another embodiment of the embodiment of FIG. 1.

In FIG. 10, there is shown a block diagram of the synchronizing and blanking circuit 53 including a warm-up timer 413 and a plasma stabilizer oscillator circuit 415. The synchronizing and blanking circuit 53 provides periodic blanking or gating pulses to the gated pulser circuit 52 (FIG. 1) to shut off the lamp every one hundred milliseconds for a five millisecond time period but delays these pulses for a warm-up time of two minutes and 16.5 seconds to avoid interfering with the ignition of the lamp 18 (FIG. 1). The significant thing about this warm-up time is that it be long enough for the lamp to warm sufficiently for the re-striking voltage to be considerably less than the initial striking voltage, although still greater than the arc-maintaining voltage.

To inhibit blanking pulses for the warm-up period, the warm-up timer 413 includes a 14-bit binary counter 412, an NPN transistor 426 and a diode 432. The binary counter 412 is a Motorola MC 14020B 14-bit binary counter manufactured by Motorola Inc. Its clock input terminal is electrically connected to one end of a resistor 442 and to the anode of the diode 432.

A source of clock pulses is connected to a terminal 452. Such a source may be an AC mains-frequency signal derived conventionally from a conventional alternating current mains-operated power supply for the direct current used by the rest of the circuitry. This terminal is connected through a resistor 444 to the other end of the resistor 442 and to ground through a resistor 446 to provide sixty hertz clock pulses to the binary counter clock input terminal when power is applied to the absorbance monitor 10 (FIG. 1).

The reset input terminal of the binary counter is electrically connected to one end of a resistor 440 and to a source of a positive 15 volts through a capacitor 438 and a resistor 436 in series. The other end of the resistor 440 is grounded. The RC circuit differentiates a signal from the source of positive potential at 437 and the differential resets the binary counter when power is initially applied to the absorbance monitor 10 (FIG. 1), providing the positive 15 volts to the terminal 437.

The base of the transistor 426 is electrically connected to the output 434A of the binary counter 412, its emitter is grounded and its collector is electrically connected to: (1) the cathode of the diode 432; (2) the plasma stabilizer oscillator circuit 415 through lead 435A in the warm-up timer circuit 413, and terminal 346, and through lead 435 in the plasma stabilizer oscillator circuit 415; and (3) a source of positive five volts 433 through a resistor 430.

In operation, when power is applied, a spike is generated by the differentiation circuit which includes resistors 436, capacitor 438 and resistor 440 from the source of positive fifteen volts at 437 and this spike resets the binary counter. Clock pulses are applied from terminal 452 at the mains power source to the clock input terminal of the binary counter 412 to cause it to begin counting for two minutes and 16.5 seconds with a 60 hertz mains power source or two minutes and 43.8 seconds from a 50 hertz source of mains power until a positive output pulse from counter 412 on lead 434A is provided to the base of the transistor 426 through resistor 434.

The positive pulse applied to the base of the NPN transistor 426 causes it to conduct, lower its collector voltage and thus pull the clock input source lower in potential through the diode 432, thus inhibiting the counter from counting further. This low collector voltage provides a low signal to the plasma stabilizer oscillator circuit 415 through a conductor 435. At this time, the plasma stabilizer oscillator circuit 415 begins generating five millisecond pulses at 100 millisecond intervals for stabilizing the plasma within the lamp 18 (FIG. 1).

To generate blanking pulses upon receiving the low signal on conductor 435, the plasma stabilizer oscillator circuit 415 includes pulse generator 414 and a transistor 418. The pulse generator 414 is a LM555 timing circuit manufactured and sold by National Semiconductor. It is adjustable to provide time delays and pulses across a wide range of such pulses and is described more fully in literature available from National Semiconductor Corporation.

To inhibit the generation of blanking pulses during the warm-up period, the NPN transistor 418 has its emitter grounded, its collector electrically connected to a source of positive 15 volts 422 through a resistor 424 and its base electrically connected to conductor 435 through a resistor 428. The output 420A of the pulse generator 414 is electrically connected through conductor 420A and a resistor 420 to the base of the transistor 418 and the output terminals for the blanking pulses 76 and 416 electrically connected to the collector of the transistor 418 so that, when conductor 435 is positive during the warm-up period under the control of the binary counter 412, transistor 418 conducts and terminals 76 and 416 are at a ground level and unaffected by pulses on the output conductor 420A of the pulse generator 414. In embodiments of this type, the conductor 149 of FIG. 1, does not interconnect synchronizing and blanking circuit 53 to gated pulser circuit 52.

At the end of the warm-up period, when conductor 435A, terminal 346 and conductor 435 drop to a low value, transistor 418 becomes nonconducting if pulse generator output lead 420A is also low and the output at conductor 149 becomes positive under the influence of the positive source 422. One hundred millisecond "on" pulses on conductor 420A now drive transistor 418 into conduction and cause the potential on lead 424A to drop to ground level. Negative-going, five millisecond "off" pulses on conductor 420A under the control of the pulse generator 414 close transistor 418 and cause positive pulses at output terminals 76 and 416. This turns off the output circuits 116 and 118 of gated pulser circuit 52 (FIG. 3), simultaneously turning off switching output transistors 61 and 63 (FIG. 2), and transformer windings at terminals 82 and 84 (FIG. 1), thus turning off the lamp 18 for five milliseconds.

To control the timing of the pulse generator 414, a source of positive voltage 417 is electrically connected through resistors 419 and 421 and through capacitor 423 to ground in series in the order named to control a threshold and trigger value for self-oscillation of the pulse generator 414. This pulse generator circuit is substantially as described in the application section of its manufacturer's literature. Capacitors 425 and 429 prevent electrical noise interference problems.

To create the oscillations within the pulse generator 414 with the proper timing, a conductor 431 connects one each of the resistors 419 and 421 to the pulse generator 414 and provides for discharging capacitor 423 through resistor 421 at the end of each pulse cycle.

A conductor 437 is connected to the resistor 421 and the capacitor 423 to provide an output signal and a trigger signal to a flip-flop within the pulse generator 414 as part of the feedback oscillation loop. A conductor 433 connects the capacitor 429 to the pulse generator 414 to filter out high frequency pulses. The capacitance of capacitor 429 is ten percent that of the capacitor 425, both of which remove voltage spikes from the circuitry.

Figure 11:
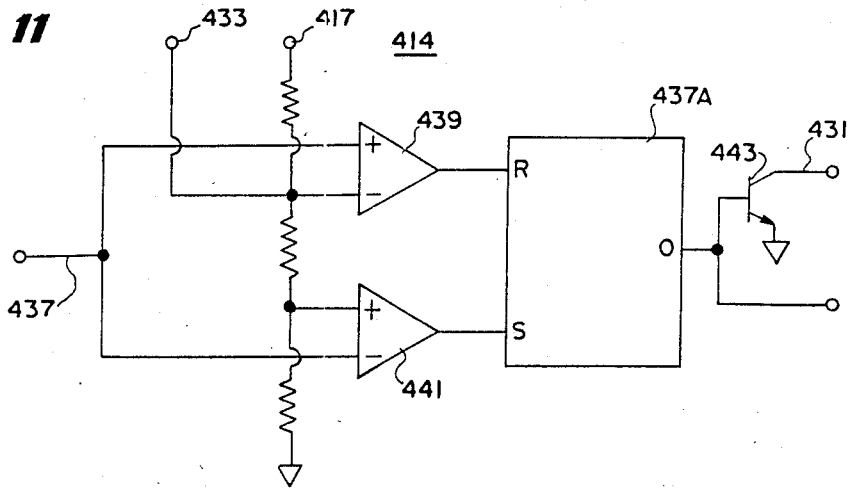
FIG. 11 is a logic circuit diagram of a portion of the circuit of FIG. 10.

In FIG. 11 there is shown a logic diagram of the National Semiconductor TTL (transistor transistor logic) style LM555 pulse generator 414 having a flip-flop 437A, a first comparator 439, a second comparator 441 and an NPN transistor 443. To form an oscillating circuit, the transistor 443 has its collector electrically connected to conductor 431 and its base electrically connected to the output of the flip-flop 437A. Conductor 437 is electrically connected to the noninverting input terminal of the comparator 439 and to the inverting terminal of the comparator 441.

With these connections, signals generated from the output of the flip-flop 437A cause a discharge of current from the capacitor 423 (FIG. 10) which has been charged from the source 417 and at the same time applies through conductor 437 a voltage pulse to the noninverting terminal of the comparator 439 and the inverting terminal of the comparator 441 to reset the flip-flop 437A which begins another cycle upon the charging of capacitor 423 (FIG. 10).

The constant source of potential from source 417 applied to the noninverting input of terminal 439 and the inverting terminal of comparator 441 maintains constant threshold values which are switched through the oscillator circuit that includes the capacitor 423 (FIG. 10). The amount of capacitance and resistances may be adjusted to control the on/off cycle and the frequency of the pulse generator 414.

In the absence of a blanking circuit, the ion path within the lamp tube 18 changes course, in a slow, continuous, rhythmical and cyclic oscillation to generate low frequency, optical noise within the tube. The blanking pulses extinguish that oscillation, thus preventing the noise.

Figure 12:
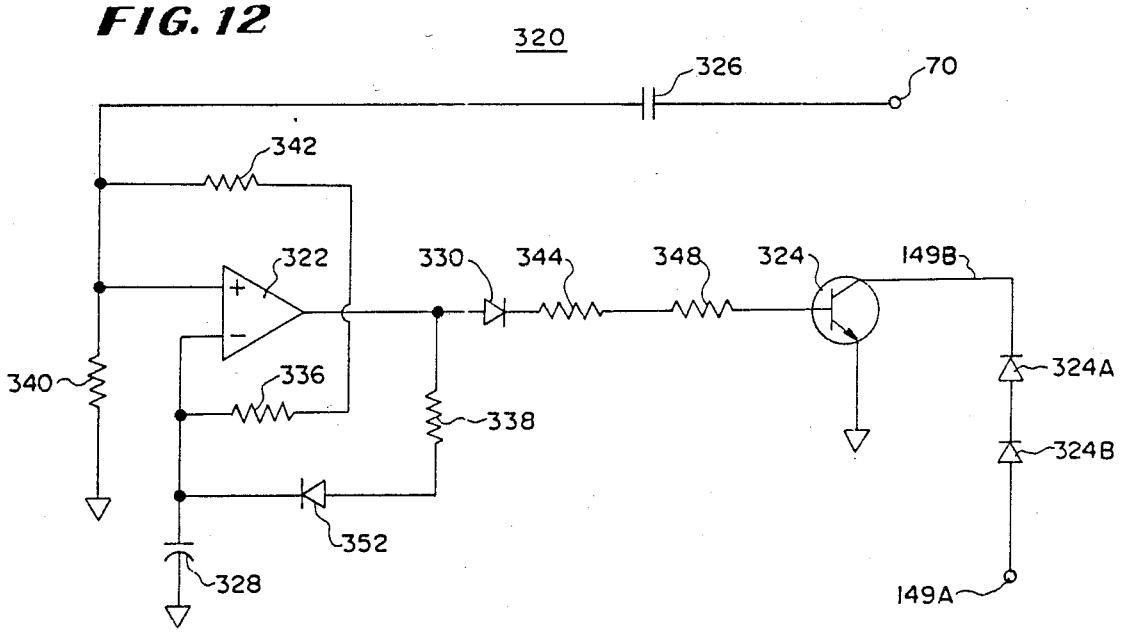
FIG. 12 is a schematic circuit diagram of another portion of the embodiment of FIG. 1.

In FIG. 12 there is shown a schematic circuit diagram of a plasma stabilizing oscillator and synchronizing circuit 320 having an operational amplifier 322, an NPN transistor 324, a first capacitor 326, a second capacitor 328, a first diode 330 and a second diode 332.

The operational amplifier 322 has its inverting input terminal electrically connected to: (1) its output through a feedback resistor 336 and through the series connection of a resistor 338 and the diode 332; and (2) AC ground through the capacitor 328. The non-inverting input terminal of the operational amplifier 322 is electrically connected to: (1) AC ground through a resistor 340; (2) the output of the operational amplifier 322 through a feedback resistor 342; and (3) one plate of the capacitor 326.

The output of the operational amplifier 322, in addition to being electrically connected to feedback resistors 342, 336 and 338 is electrically connected through the forward resistance of the diode 330, the resistor 344, and the resistor 348 to the base of the transistor 324 in series in the order named. The other plate of the capacitor 326 is electrically connected to terminal 70.

To connect the synchronizing circuit 320 to the gated pulser circuit 52 (FIG. 1), the collector of transistor 324 is electrically connected through conductor 149B, diodes 324A and 324B to terminal 149A which, in one embodiment, is connected to conductor 149 (FIGS. 1 and 3). Diodes 324A and 324B have enough voltage drop so that a high voltage applied to terminal 152 (FIG. 3) of gated pulser circuit 52 (FIG. 3) causes comparator 124 to set latch 122 and turn off both output transistors 61 and 63 and the current supplied to the primary transformer 56 in the manner described previously. Transistor 324 has its emitter electrically connected to AC ground. In embodiments using this arrangement, conductors 76 and 416 are omitted from FIG. 1 and conductor 149, in FIG. 1, is used instead.

With these connections, the stabilizing oscillator and synchronizing circuit 320 generates blanking pulses which stabilize the lamp plasma and synchronizes these pulses with the gated pulser circuit 52 (FIG. 1) by applying them to the gated pulser through terminal 149A. Applying a low synchronizing pulse to terminal 149A discharges capacitor 146 (FIG. 3) and locks one of the two drive terminals 70 or 72 "on" 20 (high).

This low amplitude synchronizing pulse on terminal 149A keeps the corresponding output transistor 61 or 63 on during the blanking pulse. The resulting high current causes the core of the lamp transformer 56 (FIG. 1) to store enough energy to supply a high enough voltage to restrike a non-warmed lamp. Thus no warm-up timer 413 (FIG. 10) is required. Return pulses are applied through terminal 70 from the gated pulser circuit 52 (FIGS. 1 20 and 2) to the stabilizing oscillator. This exchange of pulses causes the oscillators to remain in phase. Otherwise, a beat signal is generated with the stabilizing oscillator frequency and the frequency of the gated pulser circuit 52 resulting in optical noise.

The circuit of FIG. 12 may be used in conjunction with the circuit of FIG. 1 or in conjunction with a different circuit in which the current regulator 42 (FIG. 1) is only used during start-up and the frequency during running is controlled by another circuit to a value high enough that chiefly the transformer leakage inductance limits the running current. The circuit does not require the starting timer circuit 64 nor the frequency modulator circuit 62 but slowly increases to operating frequency through the uses of a frequency control circuit. These simplifications are possible because the circuit provides for a high restriking voltage after blanking and it inter-synchronizes the synchronizing and blanking circuit 53 with the gated pulser circuit 52.

Figure 13:
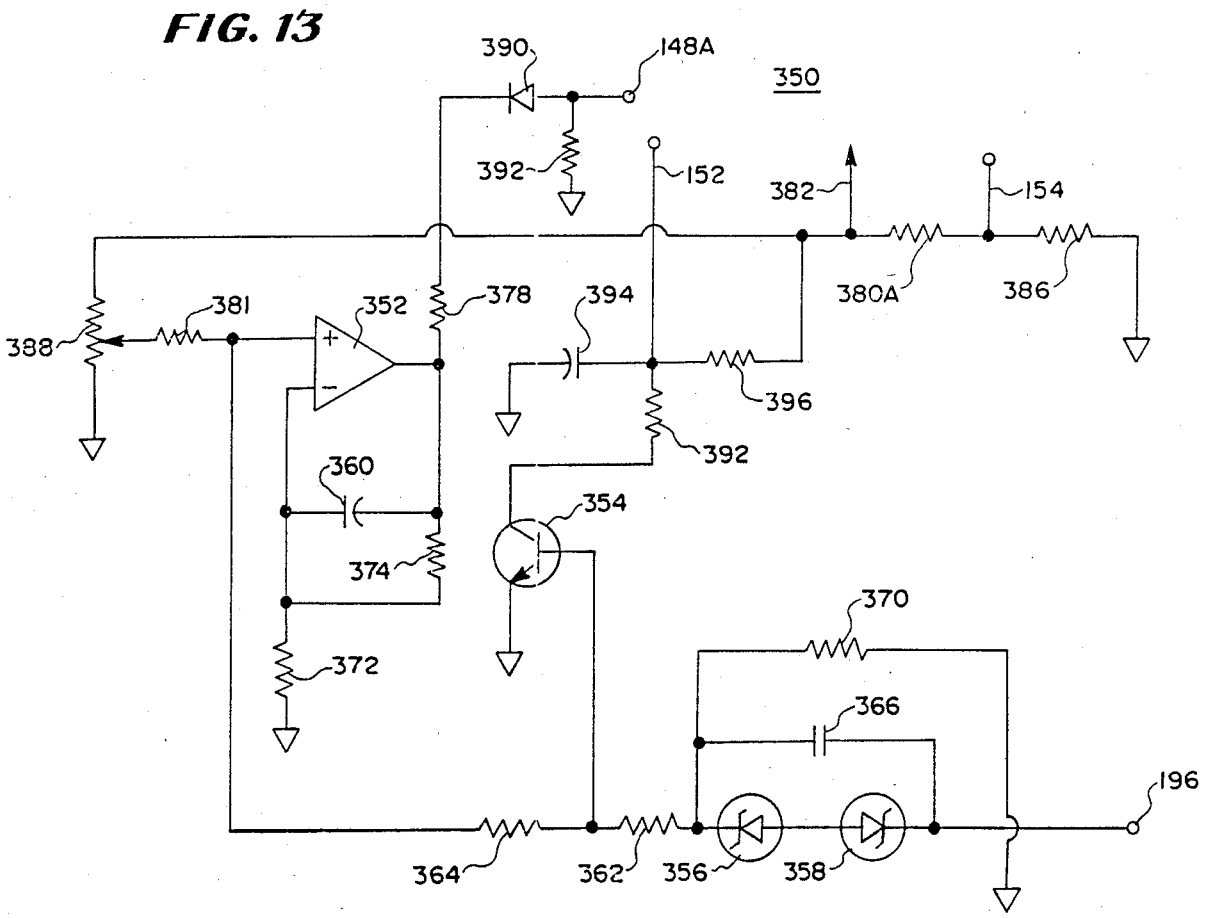
FIG. 13 is a schematic circuit diagram of another portion of the embodiment of the invention incorporating the circuit of FIG. 12.

In FIG. 13 there is shown a schematic circuit diagram of a frequency control circuit 350 which in one embodiment replaces the lamp current sensing circuit 60, the run switch circuit 62 and the frequency modulator circuit 50 (FIG. 1); and is compatible with the removal of the starting timer circuit 64 of the embodiment of FIG. 1. For this purpose it includes an operational amplifier 352, an NPN transistor 354, zener diodes 356 and 358 and a capacitor 360.

The frequency control circuit 350 senses low current during start-up and causes the transformer 56 (FIG. 1) to provide high potential pulses to the lamp 18 (FIG. 1) before ignition, and after the ignition, causes an increase in frequency as the current increases. It reaches a stable oscillation condition when the leakage inductance of the lamp transformer 56 (FIG. 1) reduces current to stabilize it at a particular frequency.

To sense the current through the lamp 18 (FIG. 1), the zener diodes 356 and 358 are a portion of a current sensing circuit similar to the circuit 60 and are in series with each other back to back with the cathode of the zener diode 358 being electrically connected to terminal 196 and the cathode of the zener diode 356 being electrically connected to the non-inverting terminal of the operational amplifier 352 through a first resistor 362 and a second resistor 364 in series in the order named.

The cathode of the zener diode 356 is also electrically connected to the cathode of the zener diode 358 and to terminal 196 through a capacitor 366 and to AC ground through lamp current-sensing resistor 370, which may differ in resistance depending on the type of lamp inserted. The rectifying action of the emitter base junction of transistor 354, whose base is connected to the junction of resistor 362 and 364, provides a negative (average) DC control voltage to the non-inverting input of amplifier 342 in response to the AC voltage drop on resistor 370 due to AC current flow through it and the lamp.

To provide a feedback and rise time slowing potential to the inverting terminal of the operational amplifier 352, the inverting terminal is electrically connected to the output of the operational amplifier 352 through a capacitor 360 and to ground through a resistor 372. The output of the operational amplifier 352 is also electrically connected to the resistor 372 through a resistor 374 and to the cathode of diode 390 through resistor 378.

The noninverting input terminal of the amplifier 352 receives a reference potential from adjustable wiper of lamp current setting potentiometer 388, the ends of which are connected between the internal reference source within the gated pulser circuit 52 indicated at 382 in FIG. 13 and AC ground.

To provide a frequency control current signal to the gated pulser circuit 52 (FIG. 1), the output terminal of the operational amplifier 352 is electrically connected to the cathode of diode 390, the anode of which is connected to the oscillator 140 (FIG. 3) at terminal 148A. Terminal 148A is connected to AC ground through resistor 392 to set a minimum frequency for oscillator 140 when diode 390 is biased off.

Upon lamp turn on after start up, lamp current produces a voltage drop across resistor 370 providing an alternating current through resistor 362 which is rectified by the base-emitter junction of transistor 354. The resulting negative average potential at the base of transistor 354 is led to the non-inverting input of amplifier 352 through resistor 364. This causes the output of amplifier 352 to progressively become more negative, turning on diode 350 through resistor 378. This increases the current through terminal 108 which is connected to input 148 which controls the frequency of oscillator 140 (FIG. 3). Therefore, oscillator 140 increases in frequency in response to the flow of lamp current through resistor 370.

To provide a shut-down signal to the other conductor 152 of the error amplifier 150 (FIG. 3) in the gated pulser circuit 52 in case the lamp does not start, the transistor 354 has its base electrically connected to the current sensor resistor 370 through the resistor 362, has its emitter grounded and has its collector electrically connected to conductor 152 through a resistor 392. Conductor 152 is electrically grounded through a capacitor 394 and is electrically connected to the source of reference potential 382 through a resistor 396. A reference potential is provided to the other conductor 154 of the error amplifier in the gated pulser circuit 52 by connection to the voltage divider composed of resistors 380A and 386, which are connected between the source of reference potential 382 and AC ground.

Lamp turn on which causes the base emitter junction of transistor 354 to turn on as described above, clamps its collector potential to AC ground. This keeps capacitor 394 discharged by conduction through resistor 392, keeping conductor 152 from rising in potential. If the lamp fails to ignite, capacitor 394 charges through resistor 396. When the potential on conductor 152 exceeds that of conductor 154, the error amplifier 150 (FIG. 3) causes comparator 124 to set latch 122, turning off the output transistors and the lamp 18.

Figure 14:
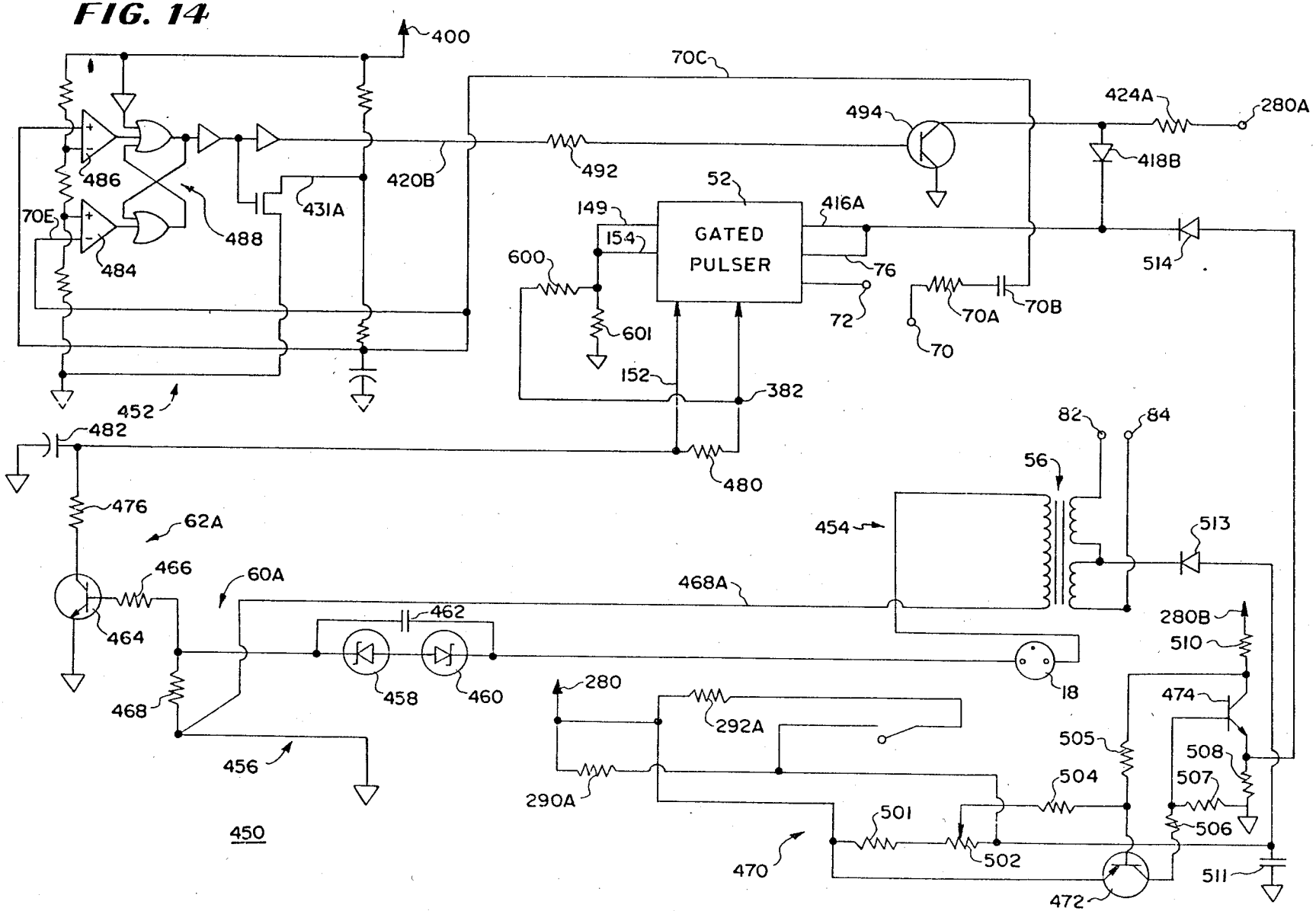
FIG. 14 is a schematic circuit diagram of another embodiment of the invention.

In FIG. 14 there is shown another embodiment of light source control circuit 450 having a blanking pulse generator 452, a frequency and current control circuit 454, lamp current sensor circuit 60A and run switch circuit 62A. The frequency and current control circuit 454 does not require the frequency modulator circuit 50 nor the current regulator circuit 42 (FIG. 1).

In this circuit, the current from the lamp 18 passes through a current sensor in lamp current sensor circuit 60A which is similar in construction to the current sensor 60 of FIG. 5 having a lamp antirectification circuit and lamp (transformer secondary) current sensing resistor 468. The antirectification circuit includes first and second back-to-back zener diodes 458 and 460 with a capacitor 462 having one plate electrically connected to the cathode of zener diode 458 and its other plate electrically connected to the cathode of the zener diode 460. The cathode of the zener diode 460 is electrically connected to the lamp 18 and the cathode of the zener diode 458 is electrically connected to the sensing resistor 468. The other end of this resistor is connected to AC ground through conductor 456.

The run switch circuit 62A includes a transistor 464, a resistor 466, a resistor 476 and a capacitor 482. The cathode of the zener diode 458 is electrically connected to the base of transistor 464 through a resistor 466 and to one end of the secondary winding of the lamp transformer 56 through a resistor 468. With this arrangement, current flowing through the secondary of the lamp transformer 56 flows through conductor 468A to one side of the resistor 468 and current from the other side of the secondary of the lamp transformer 56 flows through the lamp 18 to the other side of the resistor 468 to control the transistor 464.

To shut off the power in case the lamp does not fire, the NPN transistor 464 has its emitter grounded and its collector connected to input terminal 152 of the gated pulser circuit 52 through a resistor 476. A source of reference potential on conductor 382, produced internally within circuit 52, is electrically connected: (1) through a resistor 480 to the input lead and terminal 152; (2) to conductors 149 and 154 through resistor 600; and (3) to AC ground through resistor 601. Terminal 152 is also connected to ground through a capacitor 482.

With this arrangement, the oscillator 140 (FIG. 3) within the gated pulser circuit 52 is disabled. Resistor 144B (FIG. 3) is disconnected in this embodiment to open the collector of transistor 144. The frequency is controlled by externally triggering the flip-flop 120 within gated pulser circuit 52 through conductor 416A (FIGS. 3 and 14). This triggering is done by trigger circuit 470 which is part of the frequency current control circuit 454. Trigger circuit 470 is composed of resistors and potentiometer 501 through 510, transistors 472 and 474, diode 514 and positive sources of potential 280A and 280B.

Diode 513 and capacitor 511 isolate circuit 470 from voltage and reverse current spikes from transformer 56. Resistor 501 and potentiometer 502 form a voltage divider across transformer primary current sensing resistors 290A and 292A. When the lamp is ignited, this primary current is proportional to the lamp current in the secondary of the transformer. The position of switch 282A determines the lamp operating current and is set to correspond to the type of lamp used.

Immediately after turn on, the primary current starts to rise or "ramp up". When the voltage across the current sensing resistors, as voltage-divided down between the end of resistor 501 connected to the emitter of transistor 272 and the adjustable wiper of potentiometer 502, exceeds the base-emitter turn-on voltage of transistor 472, current from its collector turns on transistor 474.

Positive trigger and blanking voltage is then applied to terminals 416A and 76 of gated pulser 52, causing its outputs 70 and 72 to both turn off. These correspond to the same numbered inputs of the switching ouput-circuit (FIG. 1) so this turns off the primary current flow at terminals 82 and 84 (FIG. 2), producing a high voltage pulse at the secondary since potentiometer 502 is set for triggering on the primary current when it rises to about one ampere, with effects as great or greater than that described eaarlier for 0.7 ampere.

The current at which triggering takes place is inherently the maximum or peak primary current. Because of positive feedback ("hysteresis") provided by the connection of the base of transistor 472 to the collector of transistor 474, through resistor 505, the trigger and blanking voltage stays applied to gated pulser circuit 52, keeping both switching transistors 61 and 63 (FIG. 2) off until after the primary current starts to drop.

Since the triggering process at terminal 416A toggles the flip flop 120 in gated pulser circuit 52 (FIG. 3), when the current resumes it is through the opposite side of the primary of the transformer 56. On successive cycles, the current always builds up to the same amount, whereupon the aforesaid triggering action again takes place.

As the lamp 18 lights and warms, its impedance goes down, so the time to trigger decreases automatically to hold the peak current to the same amount. Thus, the frequency control is inherent because the leakage inductance of the lamp transformer 56 increases the effective transformer series impedence of the transformer to reduce the current flow to the amount set by the adjustment of the wiper of potentiometer 502.

The operating (running) primary current or transformed operating (running) current of the lamp 18 at a predetermined frequency between 100 hertz and 100,000 hertz is sufficient to create a triggering potential that causes the oscillator to generate pulses at the predetermined frequency. The waveform of the operating or running current approximates a triangle or saw-tooth wave, so the triggering current is about twice the average current. The effective lamp power is set by this average current. The drive circuit includes an inductive reactance (the transformer leakage reactance) and a trigger circuit which increases the frequency of drive pulses as the current through the lamp increases and the transformer has sufficient inductance to limit the current to the desired operating current of the lamp at a practical operating frequency.

At starting frequencies, the amplitude of the starting voltage is controlled by the magnetizing inductance and the leakage inductance does not play a major role except for losses and capacitive effects, but at the operating frequency, it controls the current through the lamp and thus the operating conditions. Because of these factors, with conventional tubes in the embodiment of FIG. 14, the ratio of the operating frequency to the starting frequency should be in a range between one-fifth and ten times the ratio of the magnetizing inductance referenced to the primary winding to the leakage inductance referenced to the primary winding.

To provide blanking pulses for the lamp 18, the blanking pulse generator 452 includes an oscillator which is the CMOS integrated circuit equivalent of the TTL-implemented integrated circuit osicillation shown in FIG. 1 comprising two comparators 484 and 486 and a filp flop stage including cross coupled NOR gates 488 energized by a source of potential 400. The output from the cross coupled NOR gates is applied through a conductor 420B in FIG. 14 (analogous to conductor 420A on FIG. 11) to resistor 492 and hence to the base of the blanking pulse transistor 494.

The collector of the blanking pulse transistor 494 is electrically connected to terminals 76 and 416A through diode 418B to provide a blanking and synchronizing output to gated pulse circuit 52. Positive potential source 280A provides power to accomplish this through resistor 424A. An input 70E from comparator 484 is connected through conductor 70C, capacitor 70B and resistor 70A to input terminal 70 to provide return synchronizing pulses from the gated pulser circuit 52 to the blanking pulse terminates the generator 452. The warm up timer 413 (FIG. 10) is not required in the embodiment of FIG. 14 because after each blanking pulse the trigger circuit 470 does not terminate the transistor conduction following the blanking pulse until the current in the primary is sufficient to store enough energy in the transformer field to re-strike the lamp.

In each of the embodiments, the magnetizing inductance of the lamp transformer 56 at the starting frequency is sufficently low so that the current flows through the lamp 18 at the starting frequency less than one-half of the time and the running frequency is high enough so the duty factor at the running frequency is at least double the duty factor at the starting frequency. Preferably, the duty factor at the operating frequency is at least fifty percent.

From the above explanation of FIG. 14, it can be seen that the operating or running current through the lamp may be sensed in the primary circuit of the transformer as well as directly at the lamp in the secondary circuit of the lamp. This is also true for a large part of the transition period between starting and running. This, of course, applies to the converse situation wherein the secondary current is a measure of the primary current.

From the above description, it can be understood that the absorbance monitor of this invention has several advantages, such as: (1) it does not require a separate high potential transformer for starting zinc or cadmium lamps; (2) it provides a relatively low noise output; (3) it is not subject to oscillation within the lamp after warm-up; (4) it is inexpensive and reliable; and (5) it can use a smaller, lower cost and lighter transformer.

Although a preferred embodiment of the invention has been described with some particularity, many modifications and variations of the preferred embodiment may be made without deviating from the invention. Therefore, it is to be understood that, within the scope of the appended claims, the invention may be practiced other than as specifically described.

What is claimed is:

1. Apparatus comprising:

a lamp transformer;

said lamp transformer having a primary and secondary winding;

said lamp transformer having sufficiently high inductance and low loss to store energy capable of creating a pulse of at least 1,000 volts amplitude with a pulse width of at least 10 microseconds across a resistance of at least 20 kiloohms in the secondary of the lamp transformer from an average current flowing through the primary corresponding to an input power load of less than five times the normal operating power;

means adapted to connect the secondary winding of said lamp transformer in circuit with a lamp;

means for sensing current through said lamp;

means for applying pulses at a comparatively low frequency to the primary of said transformer under the control of said means for sensing current;

said means for applying pulses including means for open-circuiting said primary after a current pulse has been applied, whereby a high potential spike is applied across said lamp to cause it to start;

means for increasing the frequency of said pulses as said current increases up to a first predetermined value during a first period of time;

means for limiting said current to said first predetermined value;

means for timing said first period of time until said current reaches said predetermined value;

means for terminating said pulses when time is exceeded unless said current has reached a second predetermined value that may be less or the same as the said first predetermined value;

means for applying short blanking pulses to interrupt said pulses applied to the primary of said transformer; and timing means for preventing the application of said blanking pulses for a second period of time for at least two seconds from the beginning of said application of pulses to said transformer.

2. Apparatus according to claim 1 in which said means for applying pulses includes:

a switching circuit electrically connected to said transformer primary circuit;

said switching circuit including means for causing current to flow in one direction through the primary circuit, abruptly stopping the flow of current in the said one direction and causing current to flow in the opposite direction from a source of current alternately, whereby said primary currents are abruptly stopped alternately first in one direction and then in the other direction to transmit high potential peaks from the inductive field to the secondary of said transformer; and said means for causing current to flow including means for causing the time of switching and the inductance of said primary winding to form said voltage peaks at an amplitude of at least one thousand volts before said lamp conducts at the frequency for low current through said lamp.

3. Apparatus according to claim 1 in which said means for applying pulses includes:

a switching circuit electrically connected to said transformer primary circuit;

said primary winding including a center tap and first and second end taps, whereby current may flow through the primary in either of two different directions;

said switching circuit including means for causing current to flow in one direction through the primary circuit, abruptly stopping the flow of current in said one direction and causing current to flow in the opposite direction from a source of current alternately, whereby said primary currents are abruptly stopped alternately first in one direction and then in the other direction to transmit high potential peaks from the inductive field to the secondary of said transformer; and said means for causing current to flow including means for causing the time of switching and the inductance of said primary winding to form said voltage peaks at an amplitude of least one thousand volts before said lamp conducts at the frequency for low current through said lamp.

4. Apparatus according to claim 1 in which said means for applying pulses at a low frequency includes:

a switching circuit electrically connected to said transformer primary circuit;

said primary winding including a center tap and first and second end taps, whereby current may flow through the primary in either of two directions;

said switching current including means for causing current to flow in the opposite direction from a source of current alternately, whereby said primary currents are abruptly stopped alternately first in one direction and then in the other direction to transmit high potential peaks from the inductive field to the secondary of said transformer;

said means for causing current to flow including means for causing time of switching and the inductance of said primary winding to form said voltage peaks of an amplitude of least one thousand volts before said lamp conducts at the frequency for low current through said lamp; and timing means for preventing the application of said blanking pulses for a period of time of at least two seconds from the beginning of said application of pulses to said transformer.

5. Apparatus according to claim 2 in which said means for applying pulses at a comparatively low frequency includes:

a switching circuit electrically connected to said transformer primary circuit;

said switching circuit including means for causing current to flow in one direction through the primary circuit, abruptly stopping the flow of current in said one direction and causing current to flow in the opposite direction from a source of current alternately, whereby said primary currents are abruptly stopped alternately first in one direction and then in the other direction to transmit high potential peaks from the inductive field to the secondary of said transformer;

said means for causing current to flow including means for causing the time of switching and the inductance of said primary winding to form said voltage peaks at an amplitude of at least one thousand volts before said lamp conducts at the frequency for low current through said lamp; and timing means for preventing the application of said blanking pulses for a period of time of at least two seconds from the beginning of said application of pulses to said transformer.

6. Apparatus comprising:

a lamp transformer;

said lamp transformer having a primary and a secondary winding;

means adapted to connect the secondary winding of said lamp transformer in circuit with a gas discharge lamp;

means for applying pulses to the primary of said transformer;

said means for applying pulses including means for stopping current flow to said primary after a current pulse has been applied, whereby a high potential spike is applied across said lamp to cause it to start;

means for increasing the frequency of said pulses as said current increases up to a first predetermined value during a period of time;

means for limiting said current at said first predetermined value; and said lamp transformer having sufficiently high inductance and low loss to store energy capable of creating a pulse of at least 1,000 volts amplitude with a pulse width of at least 10 microseconds across a resistance of at least 20 kiloohms in the secondary of the lamp transformer from an average current flowing through the primary corresponding to an input power load of less than five times the normal operating power.

7. Apparatus according to claim 6 further including:

means for sensing lamp current; and said means for applying pulses to the primary of said transformer including means for applying pulses to the primary of said transformer under the control of said means for sensing lamp current.

8. Apparatus according to claim 7 in which said lamp has an initial igniting voltage at least three times its running voltage.

9. Apparatus according to claim 6 further including:

means for timing said period of time until said current reaches a second predetermined value which may be the same or less than the said first predetermined value; and means for terminating said pulses when said time is exceeded unless said current has reached said second predetermined value.

10. Apparatus according to claim 6 further including means for blanking the said pulses to said primary of said transformer for a period of time at least equal to the time otherwise required for the consecutive occurrence of two of the said pulses.

11. Apparatus according to claim 6 further including:

means for blanking the said pulses to said primary of said transformer for a period of time at least equal to the time otherwise required for the consecutive occurrence of two of the said pulses; and timing means for preventing the blanking for a period of time of at least two seconds from the beginning of said application of pulses to said transformer.

12. Apparatus according to claim 10 in which said means for applying pulses to the primary of said transformer includes:

a switching circuit electrically connected to said primary winding;

said primary winding including a center tap and first and second end taps, whereby current may flow through the primary in either of two directions;

said switching circuit including means for causing current to flow in one direction while cutting off current flow in the other direction, stopping current flow from the transformer in the one direction, and causing current to flow in the opposite direction from a source of current alternately, whereby the energy in an inductive field of the transformer is discharged to a secondary circuit alternately first in one direction and then in the other direction, thus transmitting high potential peaks from the inductive field to the secondary of said transformer;

said means for causing current to flow including means for causing the time of switching and the inductance of said primary winding to form said voltage peaks having an amplitude of at least one thousand volts before said lamp conducts; and means for preventing self-rectification of said lamp after said lamp is ignited in response to the operating current through said lamp.

13. Apparatus according to claim 11 in which said means for applying pulses to the primary of said transducer includes:

a switching circuit electrically connected to said primary winding;

said primary winding including a center tap and first and second end taps, whereby current may flow through the primary in either of two directions;

said switching circuit including means for causing current to flow in one direction while cutting off current flow in the other direction, stopping current flow from the transformer in the one direction, and causing current to flow in the opposite direction from a source of current alternately, whereby the energy in an inductive field of the transformer is discharged to a secondary circuit alternately first in one direction and then in the other direction, thus transmitting high potential peaks from the inductive field to the secondary of said transformer;

said means for causing current to flow including means for causing the time of switching and the inductance of said primary winding to form said voltage peaks of an amplitude at least one thousand volts before said lamp conducts; and means for preventing self-rectification of said lamp after said lamp is ignited in response to the operating current through said lamp.

14. Apparatus according to claim 6 further including:

means for blanking the said pulses to said primary of said transformer for a period of time longer than twice the normal operating pulse duration; and timing means for preventing the application of said blanking pulses for a period of time of at least two seconds from the beginning of said application of pulses to said transformer.

15. Apparatus according to claim 14 in which said means for applying pulses includes:

a switching circuit electrically connected to said primary winding;

said primary winding including a center tap and first and second end taps, whereby current may flow through the primary in either of two directions;

said switching circuit including means for causing current to flow in one direction while cutting off current flow in the other direction, stopping current flow from the transformer in the one direction, and causing current to flow in the opposite direction from a source of current alternately, whereby the energy in an inductive field of the transformer is discharged to a secondary circuit alternately first in one direction and then in the other direction, thus transmitting high potential peaks from the inductive field to the secondary of said transformer;

said means for causing current to flow including means for causing the time of switching and the inductance of said primary winding to form voltage peaks having an amplitude at least one thousand volts before said lamp conducts; and means for preventing self-rectification of said lamp after said lamp is ignited in response to the operating current through said lamp.

16. Apparatus according to claim 6 in which said means for applying pulses includes:

a switching circuit electrically connected to said primary winding;

said primary winding including a center tap and first and second end taps, whereby current may flow through the primary in either of two directions;

said switching circuit including means for causing current to flow in one direction while cutting off current flow in the other direction, stopping current flow from the transformer in the one direction, and causing current to flow in the opposite direction from a source of current alternately, whereby the energy in an inductive field of the transformer is discharged to a secondary circuit alternately first in one direction and then in the other direction, thus transmitting high potential peaks from the inductive field to the secondary of said transformer;

means for causing current to flow including means for causing the time of switching and the inductance of said primary winding to form voltage peaks having an amplitude at least one thousand volts before said lamp conducts; and means for preventing high voltage peaks above the peak voltage of said lamp after said lamp is ignited in response to the operating current through said lamp.

17. Apparatus according to claim 6 in which said means for applying pulses includes:

a switching circuit electrically connected to said primary winding;

said primary winding including a center tap and first and second end taps, whereby current may flow through the primary in either of two directions;

said switching circuit including means for causing current to flow in one direction while cutting off current flow in the other direction, stopping current flow from the transformer in one direction, and causing current to flow in the opposite direction from a source of current alternately, whereby the energy in an inductive field of the transformer is discharged to a secondary circuit alternately first in one direction and then in the other direction, thus transmitting high potential peaks from the inductive field to the secondary of said transformer; and said means for causing current to flow including means for causing the time of switching and the inductance of said primary winding to form voltage peaks having an amplitude at least one thousand volts before said lamp conducts.

18. Apparatus according to claim 16 further including:

means for controlling the current at a first predetermined level;

said means for controlling including a triggering circuit means for sensing current and effecting stopping of current flow from a source of current alternately, each time the magnitude of the said current increases to the triggering level of the said triggering circuit, whereby said lamp inherently starts at a low frequency under the influence of large voltage spikes from the said transformer and, as the lamp starts, the frequency inherently rises to whatever is required so that the series impedance presented by the leakage inductance of the said transformer causes the current to regulate itself to the said first predetermined value.

19. Apparatus according to claim 7 in which said transformer primary includes a center tap and said switching means alternately blocks current through a first half while permitting it through the second half and blocks current through the second half while permitting it through the first half.

20. Apparatus according to claim 19 in which said switching means includes:

first and second power switches having first and second control elements and each being connected to a different end of said transformer winding; and bistable means converted to said first and second control elements for alternately driving one of said first and second power switches into conduction while driving the other into nonconducting and driving the other of said first and second power switches into conduction while driving the other into nonconduction.

21. Apparatus according to claim 18 further including means for periodically inhibiting said bistable means for short periods of time starting at least two seconds after pulses are applied to said transformer.

22. Apparatus according to claim 18 further including:

means for timing a period of time until said current reaches a second predetermined value which may be the same or less than the said first predetermined value; and means for determining said period of pulses when said time is exceeded unless said current has reached said predetermined value.

* * * * *